US010767662B2

(12) United States Patent
Tell

(10) Patent No.: US 10,767,662 B2
(45) Date of Patent: Sep. 8, 2020

(54) MULTI-STAGE VACUUM EJECTOR WITH MOLDED NOZZLE HAVING INTEGRAL VALVE ELEMENTS

(71) Applicant: Xerex AB, Taby (SE)

(72) Inventor: Peter Tell, Akersberga (SE)

(73) Assignee: PIAB AKTIEBOLAG, Taby (SE)

( * ) Notice: Subject to any disclaimer, the term of this patent is extended or adjusted under 35 U.S.C. 154(b) by 758 days.

(21) Appl. No.: 14/648,205

(22) PCT Filed: Dec. 18, 2013

(86) PCT No.: PCT/EP2013/077121

§ 371 (c)(1),
(2) Date: May 28, 2015

(87) PCT Pub. No.: WO2014/096022

PCT Pub. Date: Jun. 26, 2014

(65) Prior Publication Data

US 2015/0300377 A1 Oct. 22, 2015

(30) Foreign Application Priority Data

Dec. 21, 2012 (GB) ..... 1223420.9

(51) Int. Cl.
*F04F 5/22* (2006.01)
*F04F 5/54* (2006.01)
*F04F 5/46* (2006.01)

(52) U.S. Cl.
CPC ..... *F04F 5/22* (2013.01); *F04F 5/467* (2013.01); *F04F 5/54* (2013.01)

(58) Field of Classification Search
CPC ..... F04F 5/22; F04F 5/54; F04F 5/466; F04F 5/467; B29C 45/14; B29C 45/14336; F16L 29/00; F16L 29/02; F16K 15/031
See application file for complete search history.

(56) References Cited

U.S. PATENT DOCUMENTS 1,137,767 A 5/1915 Leblanc
1,406,145 A 2/1922 Blauhorn
(Continued)

FOREIGN PATENT DOCUMENTS

BE 486 879 A 2/1949
CN 85109727 7/1986
(Continued)

OTHER PUBLICATIONS

Machine Translation of European Patent EP 2489601 Al to Thorne published Aug. 22, 2012.*
(Continued)

*Primary Examiner* — Peter J Bertheaud
*Assistant Examiner* — Dnyanesh G Kasture
(74) *Attorney, Agent, or Firm* — Rutan & Tucker LLP

(57) ABSTRACT

A multi-stage ejector for generating a vacuum from a source of compressed air or fluid by passing the compressed air or fluid through a series of nozzles, accelerating and entraining the compressed air or fluid so as to form a jet flow in one or more stages and generate a vacuum across each stage. The multi-stage ejector may include a first drive stage; a second stage; and a converging-diverging nozzle provided in the series of nozzles between the first drive stage and the second stage. The multi-stage ejector, in use, may receive jet flow from the first drive stage, accelerate the jet flow to form a second stage air jet and direct the second stage air jet into an inlet of an outlet nozzle of the second stage. The converging-diverging nozzle may be formed in a molded nozzle piece mounted in the multi-stage ejector.

13 Claims, 13 Drawing Sheets

(56) References Cited

U.S. PATENT DOCUMENTS 1,415,406 A 5/1922 Leigh
1,491,057 A 4/1924 Myers
1,536,180 A 5/1925 Buxton et al.
1,902,729 A 3/1933 Schmidt
2,011,224 A 8/1935 Gustav et al.
2,074,480 A 3/1937 Maclean
2,200,800 A 5/1940 Miller
2,375,180 A 5/1945 Vigo
3,143,401 A 8/1964 Lambrecht
3,292,378 A * 12/1966 Rosenthal ..... A01G 25/06 239/269
3,371,618 A 3/1968 Chambers
3,474,953 A 10/1969 Duhaime et al.
3,694,107 A 9/1972 Stein
3,838,002 A 9/1974 Gluntz et al.
3,881,480 A 5/1975 Lafourcade
3,959,864 A 6/1976 Tell
3,967,849 A 7/1976 Cagle
4,037,991 A 7/1977 Taylor
4,158,528 A * 6/1979 Lasto ..... F04F 5/22 417/163
4,358,249 A 11/1982 Hanson
4,395,202 A 7/1983 Tell
4,466,778 A 8/1984 Volkmann
4,519,423 A 5/1985 Ho et al.
4,634,560 A 1/1987 Eckert
4,759,691 A 7/1988 Kroupa
4,790,054 A 12/1988 Nichols
4,807,814 A 2/1989 Douche et al.
4,880,358 A 11/1989 Lasto
5,117,871 A * 6/1992 Gardner ..... F16K 15/031 137/855
5,190,224 A * 3/1993 Hamilton ..... B05B 15/065 239/600
5,205,717 A * 4/1993 Tell ..... F04F 5/22 294/64.2
5,228,839 A 7/1993 Peterson et al.
5,374,164 A 12/1994 Schulz
5,593,284 A 1/1997 Volkmann
5,683,227 A * 11/1997 Nagai ..... F04F 5/22 417/174
5,820,353 A 10/1998 Beylich et al.
6,017,195 A * 1/2000 Skaggs ..... F04F 5/466 417/181
6,209,563 B1 * 4/2001 Seid ..... F15B 13/0405 137/15.21
6,394,760 B1 * 5/2002 Tell ..... F04F 5/467 417/174
6,582,199 B1 6/2003 Volkmann
6,851,936 B2 2/2005 Stingel et al.
6,877,960 B1 4/2005 Presz, Jr. et al.
6,955,526 B2 10/2005 Yamazaki et al.
6,976,645 B2 12/2005 Ikeda
7,452,191 B2 11/2008 Tell
7,581,374 B1 * 9/2009 Coffin ..... A01D 34/62 56/249
2001/0035222 A1 * 11/2001 Cour ..... F16K 15/031 137/855
2004/0012197 A1 * 1/2004 Guillaud ..... F16L 25/0036 285/237
2004/0105760 A1 6/2004 Eisele et al.
2005/0061378 A1 3/2005 Foret
2005/0232783 A1 10/2005 Tell
2006/0217671 A1 * 9/2006 Peppel ..... A61M 39/02 604/246
2006/0239831 A1 10/2006 Garris
2006/0284357 A1 12/2006 Goko et al.
2007/0003001 A1 1/2007 Dulka et al.
2007/0132149 A1 * 6/2007 Hildebrand ..... B05B 7/0062 264/328.16
2008/0230632 A1 9/2008 Fenton et al.
2008/0260544 A1 10/2008 Tell
2008/0292476 A1 11/2008 Cho
2009/0155668 A1 6/2009 Ban et al.
2009/0209802 A1 * 8/2009 Francescatti ..... A61N 5/1015 600/3
2009/0259316 A1 * 10/2009 Ginn ..... A61B 17/7062 623/17.16
2010/0150743 A1 6/2010 Dellach
2010/0183113 A1 7/2010 Ishida et al.
2011/0042983 A1 2/2011 Yi et al.
2011/0115243 A1 5/2011 Desai et al.
2011/0123359 A1 5/2011 Schaaf
2011/0176900 A1 7/2011 Hsieh et al.
2013/0106126 A1 5/2013 Lomerson, Jr. et al.
2014/0035304 A1 2/2014 Seebauer
2015/0308461 A1 10/2015 Tell
2015/0316074 A1 11/2015 Tell
2015/0337866 A1 11/2015 Tell
2017/0122342 A1 5/2017 Tell
2017/0275104 A1 9/2017 Tell

FOREIGN PATENT DOCUMENTS

CN 101124410 A 2/2008
CN 101297122 A 10/2008
CN 102072209 A 5/2011
CN 102654145 A 9/2012
CN 103459855 A 12/2013
DE 44 25 601 A1 1/1996
DE 195 12 700 A1 10/1996
DE 196 06 020 A1 8/1997
DE 102004034670 B3 10/2005
DE 20 2008 010424 U1 12/2009
DE 10 2009 047083 A1 5/2011
EP 0041055 A1 12/1981
EP 1213485 A2 6/2002
EP 1826160 A1 8/2007
EP 2 333 350 A1 6/2011
EP 2489601 A1 * 8/2012 ..... B29C 45/0081
EP 2 574 796 A1 4/2013
ES 1079082 U 4/2013
FR 2 580 191 A1 10/1986
GB 190 459 A 2/1958
GB 1036586 A 7/1966
GB 1230070 A 4/1971
GB 2257412 A 1/1993
GB 2262135 A 6/1993
GB 2509182 A 6/2014
IL 215423 A 4/2013
JP 22973 C 11/1912
JP 26748 C 10/1914
JP S47-22393 6/1972
JP S48-102496 A 12/1973
JP S49-100604 A 9/1974
JP S51-042101 A 4/1976
JP S56-109989 A 8/1981
JP S57-052000 A 3/1982
JP S63-144185 U 9/1988
JP H04-184000 A 6/1992
JP H04-312288 A 11/1992
JP H06-502900 A 3/1994
JP H07-054800 A 2/1995
JP H07-299787 A 11/1995
JP H08-229461 A 9/1996
JP H08-232900 A 9/1996
JP H10-502426 A 3/1998
JP H10-291664 A 11/1998
JP H11-502915 A 3/1999
JP H11-507296 A 6/1999
JP 2000-110800 A 4/2000
JP 2002-507698 A 3/2002
JP 2005-524796 A 8/2005
JP 2005282507 A 10/2005
JP 2009-513874 A 4/2009
JP 2010-030782 A 2/2010
JP 2010-168975 A 8/2010
JP 2010-276215 A 12/2010
JP 2011-058422 A 3/2011
JP 2013-248721 A 12/2013
KR 2001-0009338 A 2/2001
WO 93/03994 A1 3/1993
WO 93/04824 A1 3/1993

(56) References Cited

FOREIGN PATENT DOCUMENTS

| | | | |
|---|---|---|---|
| WO | 96/41685 | A1 | 12/1996 |
| WO | 99/49216 | A1 | 9/1999 |
| WO | 03/093678 | A1 | 11/2003 |
| WO | 2007/050011 | A1 | 5/2007 |
| WO | 2009/078797 | A1 | 6/2009 |
| WO | 2013/174240 | A1 | 11/2013 |
| WO | 2014/096023 | A1 | 6/2014 |

OTHER PUBLICATIONS

CN 201380060785.5 filed Dec. 18, 2013 Office Action dated Aug. 12, 2016.
PCT/EP2013/077121 filed Dec. 18, 2013, International Search Report dated Mar. 25, 2014.
GB1223420.9 Search Report dated Jun. 11, 2013.
JP 2015-548485 filed Mar. 4, 2015 Office Action dated Jun. 19, 2017.
U.S. Appl. No. 14/648,224, filed May 28, 2015 Final Office Action dated Jan. 25, 2018.
U.S. Appl. No. 14/648,224, filed May 28, 2015 Non-Final Office Action dated Jun. 5, 2017.
CN 201280078185.7 filed Nov. 2, 2011 Office Action dated Jul. 25, 2016.
CN 201280078224.3 filed Dec. 21, 2012 Office Action dated Jul. 26, 2016.
CN 201280078224.3 filed Dec. 21, 2012 Office Action dated Nov. 9, 2017.
CN 201380060787.4 filed Dec. 18, 2013 Office Action dated Nov. 17, 2017.
CN 201380060787.4 filed Nov. 2, 2012 Office Action dated Jun. 29, 2016.
CN 201380067194.0 filed Dec. 18, 2013 Office Action dated Jul. 4, 2016.
EP 15192314.1 filed Oct. 30, 2015 Extended European Search Report dated Apr. 22, 2016.
GB 1223418.3 Search Report dated Jun. 12, 2013.
GB 1418117.6 filed Oct. 13, 2014 UKIPO Search Report dated Mar. 29, 2015.
JP 2015-548229 filed Jun. 19, 2015 Decision of Rejection dated Feb. 5, 2018.
JP 2015-548229 filed Jun. 19, 2015 Office Action dated Aug. 29, 2016.
JP 2015-548234 filed Jun. 19, 2015 Office Action dated Sep. 5, 2016.
JP 2015-548484 filed Jun. 19, 2015 Office Action dated Jun. 19, 2016.
JP 2015-548486 filed Apr. 17, 2015 Office Action dated May 19, 2017.
PCT/EP2012/076673 filed Dec. 21, 2012 International Search Report dated May 10, 2013.
PCT/EP2012/076749 filed Dec. 21, 2012 International Search Report dated May 13, 2013.
PCT/EP2013/077119 filed Dec. 18, 2013 International Search Report date Mar. 24, 2014.
PCT/EP2013/077122 filed Dec. 18, 2013 International Search Report dated Mar. 26, 2014.
PCT/EP2015/069242 filed Aug. 21, 2015 International Preliminary Report on Patentability dated Jan. 24, 2017.
PCT/EP2015/069242 filed Aug. 21, 2015 International Search Report and Written Opinion dated Jan. 21, 2015.
U.S. Appl. No. 14/648,245, filed May 28, 2015 Final Office Action dated Mar. 19, 2018.
U.S. Appl. No. 14/648,245, filed May 28, 2015 Non-Final Office Action dated Sep. 22, 2017.
U.S. Appl. No. 14/745,243, filed Jun. 19, 2015 Final Office Action dated Apr. 11, 2018.
U.S. Appl. No. 14/745,243, filed Jun. 19, 2015 Non-Final Office Action dated Sep. 13, 2017.
U.S. Appl. No. 14/745,292, filed Jun. 19, 2015 Non-Final Office Action dated Jan. 26, 2018.
U.S. Appl. No. 14/745,292, filed Jun. 19, 2015 Restriction Requirement dated Aug. 15, 2017.
U.S. Appl. No. 15/514,461, filed Mar. 24, 2017 Non-Final Office Action dated Apr. 2, 2018.
U.S. Appl. No. 14/648,224, filed May 28, 2015 Notice of Allowance dated Sep. 20, 2018.
U.S. Appl. No. 14/648,245, filed May 28, 2015 Advisory Action dated Jul. 30, 2018.
U.S. Appl. No. 14/745,243, filed Jun. 19, 2015 Final Office Action dated Jul. 27, 2018.
U.S. Appl. No. 14/745,292, filed Jun. 19, 2015 Final Office Action dated Sep. 6, 2018.
U.S. Appl. No. 15/293,099, filed Oct. 13, 2016 Non-Final Office Action dated Sep. 24, 2018.
U.S. Appl. No. 15/514,461, filed Mar. 24, 2017 Non-Final Office Action dated Oct. 9, 2018.
CN 201610968182.0 filed Oct. 28, 2016 Office Action dated Aug. 24, 2018.
J. Conrad Crow., "Supersonic Nozzle Design", National Advisory Committee for Aeronautics Technical Note No. 1651, Jun. 1948 (Downloadable from https://ntrs.nasa.gov/archive/nasa/casi.ntrs.nasa.gov/19930082268.pdf). Jun. 1948.
JP 2015-548234 filed Jun. 19, 2015 Office Action dated Sep. 14, 2018.
Katano Yoshihi, et al., "Analysis of Supersonic Plug Nozzle Flow", Kyushu University Graduate School Comprehensive Science and Engineering Report, Heisei Jun. 13, vol. 23, No. 1, p. 31-34 (Downloadable from https://catalog.lib.kyushu-u.ac.jp/opac_download_md/16623/p031.pdf). Jun. 2001.
U.S. Appl. No. 14/745,243, filed Jun. 19, 2015 Non-Final Office Action dated Feb. 11, 2019.
U.S. Appl. No. 14/745,292, filed Jun. 19, 2015 Advisory Action dated Nov. 16, 2018.
U.S. Appl. No. 14/745,292, filed Jun. 19, 2015 Non-Final Office Action dated Dec. 31, 2018.

* cited by examiner

MULTI-STAGE VACUUM EJECTOR WITH MOLDED NOZZLE HAVING INTEGRAL VALVE ELEMENTS

PRIORITY

This application is a U.S. national stage application of International Application No. PCT/EP2013/077121, filed Dec. 18, 2013, which claims priority to United Kingdom Application No. 1223420.9, filed Dec. 21, 2012, each of which is incorporated by reference in its entirety into this application.

TECHNICAL FIELD

The present invention relates to vacuum ejectors driven by compressed air.

BACKGROUND ART

Vacuum pumps are known which use a source of compressed air (or other high-pressure fluid) in order to generate a negative pressure or vacuum in a surrounding space. Compressed-air driven ejectors operate by accelerating the high pressure air through a drive nozzle and ejecting it as an air jet at high speed across a gap between the drive nozzle and an outlet flow passage or nozzle. Fluid medium in the surrounding space between the drive nozzle and outlet nozzle is entrained into the high-speed flow of compressed air, and the jet flow of entrained medium and air originating from the compressed-air source is ejected through the outlet nozzle. As the fluid in the space between the drive and outlet nozzles is ejected in this way, a negative pressure or vacuum is created in the volume surrounding the air jet which this fluid or medium previously occupied.

For any given compressed-air source (which may also be called the drive fluid), the nozzles in the vacuum ejector may be tailored either to produce a high-volume flow, but not to obtain as high a negative pressure (i.e., the absolute pressure will not fall as low), or to obtain a higher negative pressure (i.e., the absolute pressure will be lower), but without achieving as high a volume flow rate. As such, any individual pair of a drive nozzle and outlet nozzle will be tailored either towards producing a high-volume flow rate or achieving a high negative pressure.

A high negative pressure is desirable in order to generate the maximum pressure differential with ambient pressure, and so generate the maximum suction forces which can be applied by the negative pressure, for example for lifting applications. At the same time, a high-volume flow rate is necessary in order to ensure that a volume to be evacuated can be emptied sufficiently quickly to allow for repetitive actuation of the associated vacuum device, or equally in order to convey a sufficient volume of material, in vacuum conveyer applications.

In order to achieve both a high ultimate vacuum level and a high overall volume flow rate, so-called multi-stage ejectors have been devised, which comprise three or more nozzles arranged in series within a housing, each adjacent pair of nozzles in the series defining a respective stage across which a negative pressure is generated in the gap between the adjacent two nozzles. Again, in general, any individual pair of nozzles in the series may be tailored either towards producing a high-volume flow rate or achieving a high negative pressure, for a given source of compressed air.

In such multi-stage ejectors, the earliest stages produce the highest levels of negative pressure, i.e., the lowest absolute pressures, whilst the subsequent stages provide successively lower negative pressure levels, i.e., higher absolute pressures, but increase the overall volume throughput of the ejector device. In order to apply the generated vacuum across the multiple stages to a desired vacuum device or volume to be evacuated, the successive stages are typically connected to a common collection chamber, whilst valves are provided to each successive stage, at least after the first, drive stage, so that the subsequent stages can be closed off from the collection chamber once the negative pressure in that chamber has been reduced below the negative pressure which the second and subsequent stages are able to generate.

The drive stage is so-called because it is the only stage connected to the source of pressurised fluid (compressed air), and so drives the flow of pressurised fluid through all of the subsequent stages and nozzles in the series, before the drive fluid and entrained fluid is ejected from the vacuum ejector.

In order to provide for the entrainment of fluid across each successive stage, the series of nozzles present a through-channel with gradually increasing sectional opening area, through which the stream of high-speed fluid is fed in order to entrain air or other medium in the surrounding volume into the high-speed jet flow. The nozzles between each stage form the outlet nozzle of one stage and the inlet nozzle of the next stage, and are configured to successively accelerate the flow of air and other medium in order to direct a high-speed jet of the fluid across each successive stage.

Although different pressurised fluids may be utilised as the drive fluid, multi-stage ejectors of the present type are typically driven by compressed air, and most usually are used to entrain air as the medium to be evacuated from the volume surrounding the jet flow through each gap in the series of nozzles, across the respective stages.

One design of multi-stage ejector which has found commercial success is to present the series of nozzles in a coaxial arrangement within a substantially cylindrical housing which incorporates a series of suction ports therein in communication with each stage of the ejector, the suction ports being provided with suitable valve members for selectively communicating each stage with a surrounding volume of air. So presented, the cylindrical body is formed as a so-called ejector cartridge, which, when installed inside a housing module, or within a suitably dimensioned bore hole, can be used to evacuate the surrounding chamber, which is in turn fluidly coupled to the vacuum device to which the negative pressure is to be applied.

Such a device is disclosed in PCT International Publication No. WO 99/49216 A1, in the name of PIAB AB, and is shown in FIGS. 14 and 15 of the present application.

As shown in FIG. 14, the ejector cartridge 1 comprises four jet-shaped nozzles 2, 3, 4 and 5 which define a through-channel 6 with gradually increasing cross-sectional opening area. The nozzles are arranged end-to-end in series with respective slots 7, 8 and 9 between them.

The nozzles 2, 3, 4 and 5 are formed in respective nozzle bodies, which are designed to be assembled together to form an integrated nozzle body 1. Through openings 10 are arranged in the wall of the nozzle body, to provide flow communication with an outer surrounding space.

Turning to FIG. 15, it can be seen how the ejector cartridge 1 may be mounted within a bore hole or housing, in which the outer surrounding space corresponds to a chamber V to be evacuated. Each of the through openings 10 is provided with a valve member 11 in order to selectively permit the flow of air or other fluid from the surrounding space V into the space or chamber between each adjacent pair of nozzles. As shown in FIG. 15, the ejector cartridge 1 has been mounted in a machine component 20, in which the bore hole has been drilled or otherwise formed. The ejector cartridge 1 extends from an inlet chamber i to an outlet chamber u, and is arranged to evacuate the three separate chambers constituting the outer surrounding space V, each of which is separated from the adjacent chamber by an O-ring 22. Although not shown, each of the chambers constituting the outer surrounding space V is connected to a common collection chamber or suction port, in order to apply the generated negative pressure to an associated vacuum-operated device, such as a suction cup.

Although such multi-stage ejector arrangements are beneficial in providing both a high-volume flow rate and a high level of negative pressure, there is necessarily still some degree of compromise in the design of each successive stage in the ejector, in order to obtain an overall desired performance characteristic for the multi-stage ejector as a whole. Accordingly, it has also been proposed to provide a further so-called booster nozzle, provided in parallel with the drive nozzle of the multi-stage ejector, where the booster nozzle is specifically designed to obtain the highest possible level of vacuum, but does not form part of the series of coaxially arranged nozzles which make up the multi-stage ejector. In this way, the booster nozzle can be configured to obtain the highest possible level of vacuum, whilst the parallel multi-stage ejector nozzle series can be arranged to obtain a high-volume throughput, which enables a high negative pressure (low absolute pressure) to be obtained within the volume to be evacuated within an acceptably short period of time.

Such an arrangement is disclosed in U.S. Pat. No. 4,395,202, as shown in FIG. 13 of the present application. In this arrangement, there is provided a set of ejector nozzles 12, 13, 14, 15 arranged successively for evacuation of associated chambers 5, 6, 7, which are in mutual communication with a vacuum collecting compartment 16 through respective ports 18, 19 and 20. Valves, 21, 22 and 23 are respectively provided to the ports 18, 19 and 20.

An additional pair of nozzles 24 and 25 is provided in parallel to the drive nozzle 12 of the multi-stage ejector, and is arranged in a separate booster chamber 4, connected to the collecting chamber 16 via a port 17. The booster stage is comprised of a pair of nozzles 24 and 25, with the inlet nozzle 24 being connected, together with the drive nozzle 12 of the multi-stage ejector, to the inlet chamber 3, which is supplied with compressed air. The pair of nozzles 24 and 25 across the booster stage serves to generate the highest possible vacuum (lowest negative pressure) in the booster chamber 4. The jet of compressed air which is generated by the nozzle 24 is ejected out of the booster stage through nozzle 25, into the same chamber 5 across which the drive nozzle 12 propels the drive jet of compressed air. In this way, the air expelled out of the booster stage is entrained into the drive jet flow to be expelled from the multi-stage ejector. Furthermore, the vacuum generated by the drive stage of the multi-stage ejector is applied to the exit of nozzle 25, so that the pressure differential across the booster stage is increased whereby the vacuum level which can be generated by the booster stage can be increased, i.e., the absolute pressure which can be obtained is reduced.

In operation of the vacuum ejector, the series of nozzles 12, 13, 14 and 15 of the multi-stage ejector is able to produce a high volume flow rate so as quickly to generate a vacuum to a low absolute pressure in the collecting chamber 16 within a short period of time by entraining fluid from each of the chambers 5, 6 and 7 and the collecting chamber 16 into the jet streams formed by each successive stage of the ejector. The booster stage functions in parallel to the multi-stage ejector, but typically produces a low volume flow rate, and so does not contribute significantly to the initial vacuum formation process. As the vacuum level in the collecting chamber 16 increases (i.e., as the absolute pressure falls), the associated valve members 23, 22 and 21 will close in turn, as the pressure in the vacuum collecting chamber 16 drops below the pressure in the associated chamber 7, 6 or 5, respectively. Eventually, the pressure in the collection chamber 16 will fall below the lowest pressure that any of the stages of the multi-stage ejector is able to generate, so that all of the valves are closed, and all further evacuation will then be done by the booster stage, which provides suction to the collection chamber 16 via suction port 17.

Such multi-stage ejectors and ejector cartridges as described above have found commercial success in a number of different industries, and in particular in the manufacturing industry, where such vacuum ejectors may be connected to suction cups and used for picking and placing components during an assembly process.

As the demands for high vacuum levels (i.e. low absolute pressures) in processes such as de-gassing, de-humidifying, filling of hydraulic systems, forced filtration, etc., continue to increase, there is increasing demand for vacuum ejectors which are able to repeatedly provide a high level of negative pressure (i.e., a low absolute pressure) in order to carry out the above and other processes.

Coupled with this, there is an increasing drive towards smaller-sized ejectors, which are able to provide the desired evacuation capability at remote locations on the machinery (i.e., at the ends of mechanical arms, and significant distances from the ultimate source of compressed air) without negatively impacting on the overall dimensions of the machine. In particular, there is a desire for ejector devices having a small footprint, and so able to apply a vacuum to increasingly compact working areas.

SUMMARY OF THE INVENTION

The invention provides a multi-stage ejector for generating a vacuum from a source of compressed air by passing said compressed air through a series of nozzles, accelerating said compressed air, and entraining air so as to form a jet flow in one or more stages and generate a vacuum across each stage, the multi-stage ejector comprising a drive stage; a second stage; and a converging-diverging nozzle provided in said series of nozzles between said drive stage and said second stage for receiving jet flow from said drive stage and accelerating said jet flow to form a second stage air jet and directing said second stage air jet into an inlet of an outlet nozzle of the second stage, wherein said converging-diverging nozzle is formed in a moulded nozzle piece mounted in said multi-stage ejector.

A method of making a multi-stage ejector cartridge for generating a vacuum from a source of compressed air by passing said compressed air through a series of nozzles, accelerating said compressed air, and entraining air so as to form a jet flow in at least a drive stage and a second stage and generate a vacuum across each of these stages, the method comprising mounting a moulded nozzle piece including a converging-diverging nozzle between the drive stage and the second stage.

Relative to the prior art discussed above, the invention renders the manufacturing of an at least equally efficient multi-stage ejector more cost-efficient.

BRIEF DESCRIPTION OF THE DRAWINGS

To enable a better understanding of the present invention, and to show how the same may be carried into effect, reference will now be made, by way of example only, to the accompanying drawings, in which:—

FIG. 11B showing a longitudinal, axial sectional view through the ejector housing module, as seen in a direction perpendicular to the direction of airflow through the ejector, detailing how the cartridge of FIG. 1A is mounted into the housing module, and FIG. 11C showing a top plan view of the ejector housing module, including the location of mounting holes for connecting the housing module to the mounting plate;

DETAILED DESCRIPTION

Figure 1A:
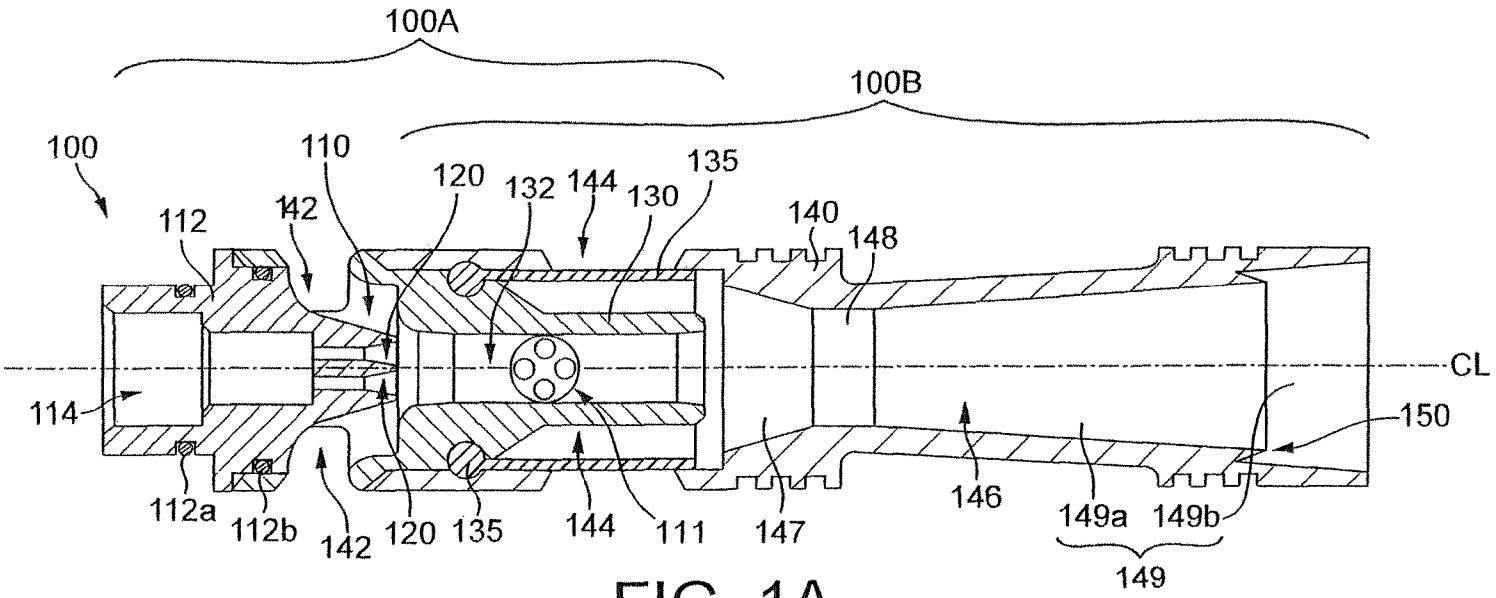
FIG. 1A shows a longitudinal, axial sectional view through a first embodiment of an ejector cartridge according to the present invention, as seen in a direction perpendicular to the direction of airflow through the ejector cartridge.

Embodiments of the present invention will now be described with reference to the accompanying Figures. Like reference numerals have been used to refer to like features throughout the description of the various embodiments.

Figure 1B:
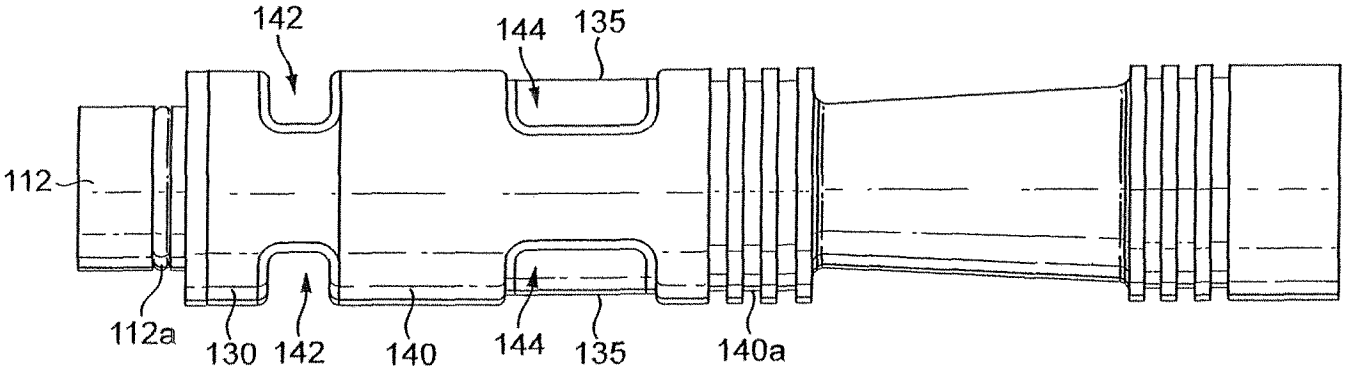
FIG. 1B shows a perspective side view of the ejector cartridge of FIG. 1A, from the same direction as FIG. 1A.

FIGS. 1A and 1B show a first embodiment of an ejector according to the present invention. The embodiment of FIGS. 1A and 1B is configured as an ejector cartridge 100. Such a cartridge is intended to be installed within an ejector housing module, or within a bore or chamber formed in an associated piece of equipment, which defines the volume to be evacuated by the ejector cartridge.

Although the most preferred embodiment of the ejector, as shown in the drawings, is designed to work with air as the drive fluid, and as the fluid to be evacuated, the ejector will be applicable to any gas as the drive fluid, and any gas as the fluid to be evacuated. The drive fluid will have a primary direction of movement, or flow, through the ejector. This direction is parallel to the longitudinal axis of the ejector, shown horizontally in the drawings, and starting from the inlet 114. In the following, this direction will be referred to as the direction of airflow.

Ejector cartridge 100 is a multi-stage ejector having a first, drive stage 100A and a second stage 100B, for generating a respective vacuum across each stage.

The drive stage comprises a drive nozzle array 110, which is arranged to accelerate compressed air supplied to the inlet 114 of the drive nozzle array 110, so as direct a jet flow of high speed air into the inlet of a second stage nozzle 132. Second stage nozzle 132 is, likewise, arranged to project a jet flow of air into an exit nozzle 146 of the ejector cartridge.

Figure 14:
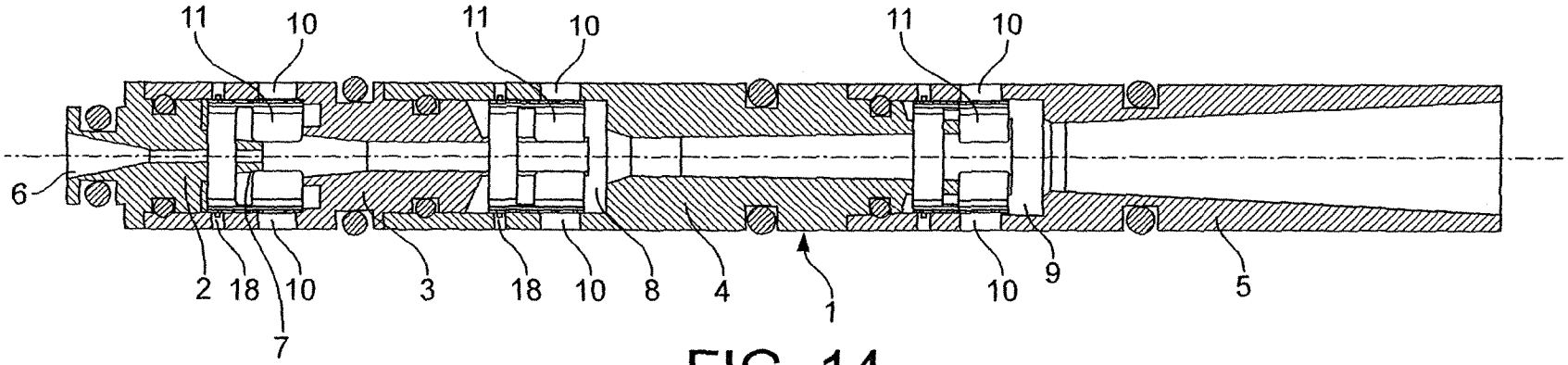
FIGS. 14 and 15 show sectional views of a prior art ejector cartridge, with FIG. 15 illustrating a cartridge being mounted into a housing unit of an ejector.
Figure 15:
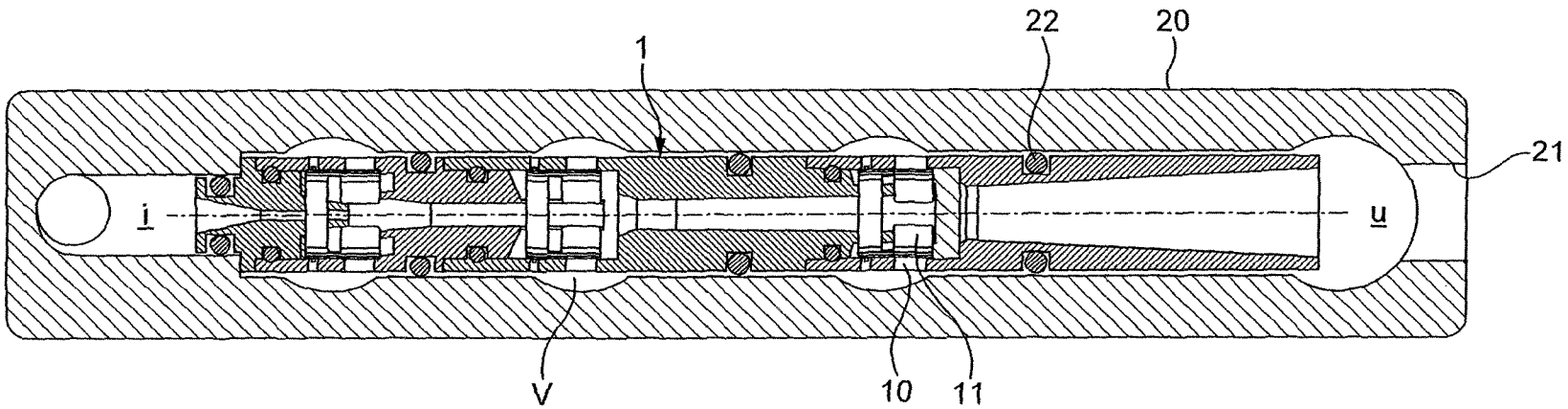

Unlike with the ejector cartridge shown in FIGS. 14 and 15 of the present application, which has a single drive nozzle, the ejector cartridge 100 includes a drive nozzle array 110, which has plurality of drive nozzles 120. The drive nozzles 120 are each configured to generate an air jet of high speed air across the drive stage of the ejector cartridge 100, and are grouped so that the individual jet flows generated by each of the drive nozzles 120 will all be fed together in common into the inlet 131 of the second stage nozzle 132.

In FIG. 1A, 111 indicates a view onto nozzle array 110, as seen from second stage drive nozzle 132. Even though the view 111 is shown in the second stage nozzle, 132, this is done for illustrative purposes only. As shown schematically in FIG. 1A, the drive nozzle array 110 includes four drive nozzles 120, which are grouped together in a two-by-two matrix in such a way that the outlets of the four drive nozzles, when viewed in an axial direction along centre axis CL of the ejector cartridge 100, will all lie within a boundary perimeter essentially equal to the smallest inner diameter of the second stage nozzle 132. This is shown in FIG. 1A by a circle drawn part way along the length of the second stage nozzle 132, corresponding to the inner cross-section of the second stage nozzle perpendicular to the centre axis CL, and having four smaller circles drawn within its perimeter, which shows how the outlet positions of four drive nozzles 120 could be arranged so that they are all aligned with the inlet of the second stage nozzle in the direction of the centre axis CL. It will be appreciated that this larger circle and the four smaller circles do not represent a structural feature part way along the second stage nozzle 132, but are a projection of the drive nozzle array grouping onto the cross-section of the second stage nozzle, made for purposes of illustrating the relative concentric and coaxial alignment of these components along centre axis CL. The same applies for the similar circular groupings shown part way along the second stage nozzles in FIGS. 2 and 6.

Subsequent to the drive nozzle array, in the direction of airflow through the ejector, are the second stage nozzle 132 and the exit nozzle 146. These nozzles are each provided as single, converging-diverging nozzles, provided in series with the drive nozzle array 110 along the centre axis CL. Accordingly, when compressed air is supplied to the inlet 114 of the drive nozzle piece 112 at the inlet of the ejector cartridge 100, a high-speed air jet will be generated by each of the nozzles 120, so as to form a jet flow in which the drive air jets are directed together in common into the inlet 131 of the second stage nozzle 132. In this way, air or other fluid medium in the volume between the drive nozzle array 110 and the inlet 131 of the second stage nozzle 132, in particular the volume surrounding each of the drive jets generated by the respective drive nozzles 120, will be entrained into the jet flow, and driven into the second stage nozzle 132.

The consumption and the feed pressure of the supplied compressed air can vary in accordance with ejector size and desired evacuation characteristics. For smaller ejectors, a consumption range from about 0.1 to about 0.2 Nl/s (normalized litres per second) at feed pressures of from about 0.1 to about 0.25 MPa will usually be sufficient, and large ejectors typically consume from about 1.25 to about 1.75 Nl/s at about 0.4 to about 0.6 MPa. Ranges in between for sizes in between are possible and common. Without wishing to be bound to these particular ranges, compressed air as used herein is to be understood to have such properties.

The fluid in the jet flow exiting the drive stage is then accelerated in the second stage converging-diverging nozzle 132, so as to generate an air jet across the second stage 100B, which is in turn directed into the inlet of the exit nozzle 146. In the same way, air or other fluid medium in the volume surrounding the air jet generated by the second stage nozzle 132 will be entrained into the jet flow, and ejected from the ejector cartridge 100 through the exit nozzle 146.

When fluid is entrained into the respective jet flows in the first stage 100A and second stage 100B, a suction force is generated which will tend to draw further fluid media from the surrounding environment into the ejector cartridge 100 through the suction ports 142 and 144 which are disposed around the body of the ejector cartridge 100, respectively associated with each of the first stage 100A and the second stage 100B. As described above, the drive stage 100A will generate a higher value of negative pressure (i.e., a lower absolute pressure) than the second stage 100B. Accordingly, a valve member 135 is provided to selectively open and close the suction ports 144 of the second stage 100B. The valve member 133 closes off the suction ports 144 when the negative pressure generated in the surrounding volume exceeds that which can be generated in the second stage 100B. Closing the ports prevents any backflow of the air being evacuated by the drive stage 100A; backflow would result from this air re-entering the volume to be evacuated out of the second stage 100B through the suction port 144 under a condition of reverse flow.

Figure 2:
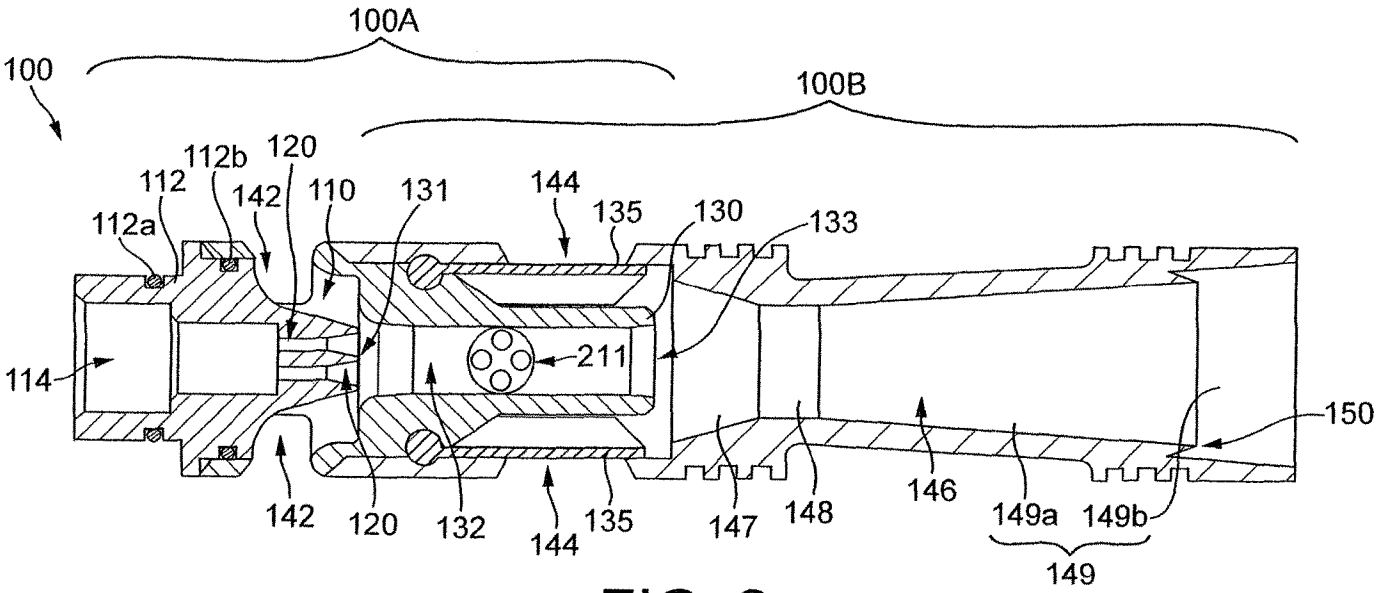
FIG. 2 shows a longitudinal, axial sectional view of a second embodiment of an ejector cartridge according to the present invention, similar to the embodiment of FIG. 1A, but having separate flap valves in place of the unitary valve member of FIG. 1A, as seen in a direction perpendicular to the direction of airflow through the ejector cartridge.

In the embodiment of FIG. 1A, the valve member 125 is provided as a unitary body which extends around the whole inner circumference of the second stage 100B of the vacuum ejector cartridge 100, in order to selectively open and close the suction ports 144 according to the pressure difference between the negative pressure generated in the second stage 100B and the external vacuum condition in the surrounding volume. As an alternative, as shown in FIG. 2, a number of separate flap-valve members, or one member having a number of separate valve flaps 135, can be provided, one associated with each of the suction ports 144.

As will be apparent from FIG. 1B, the ejector cartridge 100 is formed as a substantially rotationally symmetric body, forming a body of revolution about the centre axis CL, with the exception of the drive nozzle array 110 and the suction ports 142 and 144. Although the drive nozzle array 110 and the portions including suction ports 142 and 144 do not, strictly-speaking, form bodies of revolution, they may be disposed with rotational symmetry about said axis of rotation CL, thus representing only minor discontinuities in what is otherwise a body of revolution about the centre axis CL.

As shown in FIGS. 1A and 1B, the ejector cartridge 100 is a substantially cylindrical ejector cartridge having a substantially circular cross-sectional shape along its length in the plane perpendicular to the centre axis CL, i.e., perpendicular to the direction of airflow through the ejector cartridge 100. However, it will be appreciated that it is not essential for the ejector cartridge 100, or the components thereof, to be formed with a circular cross-section, and the various nozzles, in particular, can be formed with square or other non-circular cross-sections, should this be suitable for a particular application. Nevertheless, a substantially cylindrical or tubular form is preferred for the ejector cartridge 100, since this permits the ejector cartridge 100 to be installed most easily within a borehole or other ejector housing module, utilising appropriate seals such as the O-rings 112*a* and 140*a* shown in FIGS. 1A and 1B.

Turning to the particular construction of the ejector cartridge 100 of FIGS. 1A and 1B, it can be seen that the ejector cartridge is constituted by a two-part housing, consisting of second stage housing piece 140 and drive stage housing piece 130. A drive nozzle piece 112, defining the drive nozzle array 110, is mounted into the inlet end of the drive stage housing piece 130. The valve member 135 is, in this embodiment, formed as a separate member, and is mounted to the drive stage housing piece 130 in a corresponding, and preferably circumferential, groove formed in that housing, so as to be assembled into the ejector cartridge 100 when the drive stage housing piece 130 is inserted into the inlet end of second stage housing piece 140.

Figure 3A:
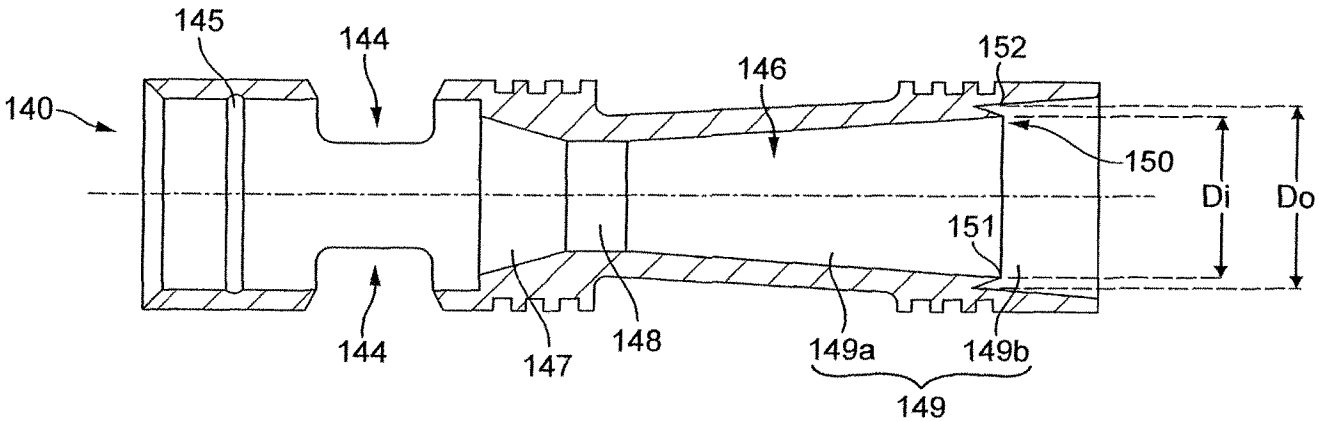
FIG. 3A shows a longitudinal, axial sectional view of the unitary ejector housing body, defining the second stage and exit nozzle, of the ejector cartridge of FIGS. 1A and 2, as seen in a direction perpendicular to the direction of airflow through the ejector cartridge.
Figure 3C:
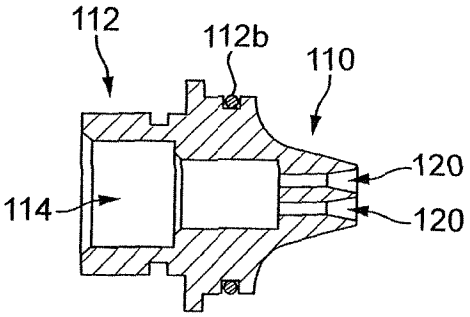
FIG. 3C shows a longitudinal, axial sectional view of the drive nozzle piece of FIGS. 1A and 2, as seen in a direction perpendicular to the direction of airflow through the ejector cartridge.
Figure 3B:
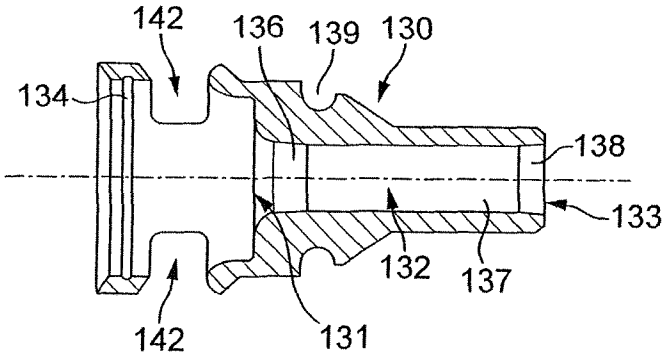
FIG. 3B shows a longitudinal, axial sectional view of the unitary drive stage housing piece, including the second stage nozzle, of FIGS. 1A and 2, as seen in a direction perpendicular to the direction of airflow through the ejector cartridge.

With reference also to FIGS. 3A to 3C, the components of the ejector cartridge 100 will be described in more detail.

The second stage housing piece 140 includes an inlet portion, which has receiving structure 145 arranged to receive the drive stage housing piece 130 which, in turn, receives the drive nozzle array 110. As will be appreciated from FIG. 1A, the valve member 135 engages with the receiving structure 145 and serves to provide a seal between the second stage housing piece 140 and the drive stage housing piece 130, when the drive stage housing piece 130 is mounted into the inlet end of the second stage housing piece 140.

Second stage housing piece 140 defines a converging-diverging nozzle 146, which constitutes the exit nozzle of the ejector cartridge 100. This converging-diverging nozzle 146 includes a converging inlet section 147, a straight section 148 and a diverging section 149. Straight section 148 could be slightly diverging, too. The second stage housing piece 140 also defines the second stage suction ports 144, through which air or other fluid medium in the surrounding volume is sucked into the second stage so as to be ejected from the ejector cartridge 100 through exit nozzle 146.

A particular feature of the exit nozzle 146 is that the diverging section 149 includes a stepwise expansion in diameter 150, formed part way along the diverging section 149, in this example nearer to the outlet end of the nozzle 146 than to the inlet of the diverging section 149; in the illustrated embodiment, the expansion is near to the outlet end of the exit nozzle 146. The first section 149*a* of the diverging nozzle section 149 extends from the straight section 148 with a divergence angle which may be substantially constant, up to the point where the stepwise expansion in diameter is provided at a sharp corner 151. Preferably, the sharp corner 151 is defined by an undercut in the diverging section 149 of the nozzle 146. At the stepwise expansion in diameter 150, the wall of the diverging section reverses direction to form the sharp corner 151, where the wall changes from diverging whilst extending in an axial direction towards the exit end of the ejector cartridge 100, to being diverging whilst extending in an axial direction towards the inlet end of the ejector cartridge 100, for a short distance, before reversing back to again diverge whilst extending in the axial direction towards the outlet end of the cartridge 100. The last reversal back into a diverging shape is optional in that the second portion 149*b* as shown in the Figures may initially, i.e. immediately downstream of the sharp corner, may reverse back to continue in a cylindrical, straight-walled shape, before it continues in a diverging shape shortly before the outlet end of the cartridge 100. The shape of the nozzle 146 will be selected in accordance with the desired characteristics of the ejector, keeping in mind that the shape serves to render the change from the flow and pressure conditions in the nozzle to the expansion of the flow into ambient pressure less abrupt. In this manner, the design of the outlet end of the cartridge 100 can advantageously used to influence pressure and flow rate conditions in the drive nozzle. As a result the skilled person will have greater freedom in designing the drive nozzle.

As shown in FIG. 3A, the stepwise change in diameter can be measured by comparing the diameter Di immediately before the stepwise expansion, at the sharp corner 151, with the diameter Do immediately after the stepwise expansion, at the point 152 which is radially in-line with point 151, but on the second diverging portion 149*b* of the diverging section 149. A stepwise change in diameter serves to trip the fluid flow in the diverging section 149*b* of the nozzle 146, so as to generate a turbulent outlet flow along the nozzle wall, thereby reducing the friction at the outlet of the nozzle 146 and correspondingly improving the efficiency with which the ejector cartridge 100 can generate a vacuum from a given source of compressed air.

The ratio Di to Do is preferably between 6 to 7 and 20 to 21, and most preferably is about 94 to 105.

Turning to FIG. 3B, there is shown the drive stage housing piece 130, which defines an inlet section in which suction ports 142 are formed, through which air or other surrounding medium may be sucked into the drive stage to be ejected through the second stage nozzle and the exit nozzle of the ejector cartridge 100. The drive stage housing piece 130 includes an annular groove 139, for receiving the valve body 135 therein. Equally, the annular groove 139 may be provided as a series of separate grooves, for receiving individual valve members 135, for the respective suction openings 144.

The drive stage housing piece 130 also forms a nozzle body, in which the converging-diverging second stage nozzle 132 is defined, having a converging inlet section 136, a straight middle section 137 and a diverging outlet section 138. The second stage nozzle defines an inlet 131 and an outlet 133. Furthermore, the second stage nozzle piece 130 defines a receiving structure 134, such as in the form of an annular groove, for mounting the drive nozzle piece 112 into the inlet end of the drive stage housing piece 130. In this way, a notch or equivalent engaging structure may be provided on the drive nozzle piece 112, to engage with the groove 134, or otherwise an annular O-ring seal 112*b* may be provided so as to couple the drive nozzle piece 112 and the drive stage housing piece 130 together by being mutually received in respective grooves of these two components.

Turning to FIG. 3C, the drive nozzle piece 112 is shown, provided with such an O-ring 112*b* for forming a sealed interconnection with receiving structure such as annular groove 134 at the inlet end of the drive stage housing piece 130. The drive nozzle piece 112 is provided with the drive nozzle array 110, which includes a plurality of drive nozzles 120. The drive nozzle piece 112 includes an inlet 114, to which the compressed air supply is provided for supplying compressed air to the drive nozzles 120 in order to generate respective air jets of high speed air from each drive nozzle 120. The fluid flow produced by the drive jets and any fluid medium entrained therein may in general be termed as jet flow or drive jet flow.

Figure 4:
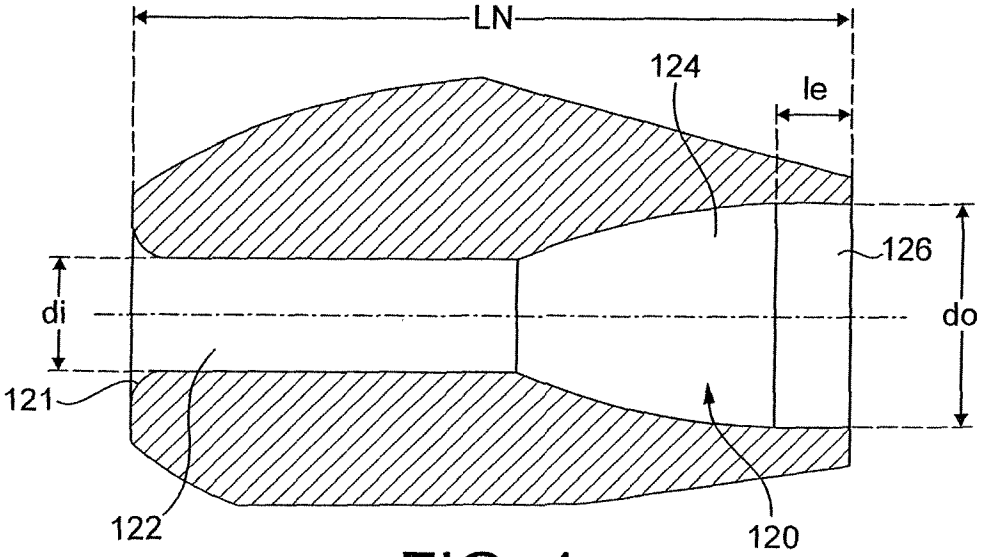
FIG. 4 shows an enlarged partial longitudinal, axial sectional view detailing one form of a drive nozzle which may be used in the drive nozzle arrays of the ejectors disclosed herein, as seen in a direction perpendicular to the direction of airflow through the drive nozzle.

FIG. 4 shows an enlarged cross-sectional view through a drive nozzle 120. In this case, the drive nozzle 120 is formed with a circular cross-section, as viewed in the axial direction of each nozzle, although non-circular cross-sections are also possible, with equivalent fluid dynamic effect.

Each of the drive nozzles 120 may be formed in the drive nozzle piece 112 in the manner shown in FIG. 4, so as to have a straight-walled inlet flow section 122 and a diverging outlet flow section 124. The straight-walled inlet flow section is neither converging nor diverging, and is provided with a radiused, rounded or chamfered edge or edges at the inlet 121. The diverging outlet flow section 124 extends from the outlet end of the straight-walled section 122 so as to exhibit a decreasing degree of divergence along its length towards the exit end of the drive nozzle. That is to say, that the diverging section 124 is most divergent at the inlet end of the outlet flow section 124, where it extends from the straight-walled portion 122, and is least divergent at the outlet end of that section 124. The diverging section 124 may also comprise a further straight-walled section 126 at the exit end of diverging outlet flow section 124. As viewed in cross-section, in a direction perpendicular to the direction of air flow through the drive nozzle 120, the diverging section 124 has the shape of a segment of an ellipse lying with its foci on the longitudinal centre axis of the straight-walled inlet flow section 122, and extends from the most-diverging end to the least-diverging end of the diverging nozzle section 124.

If a straight-walled section 126 is provided at the exit of the drive nozzle 120, this section preferably has a length le which is 12% or less, preferably 10% or less, than the overall length LN of the drive nozzle as a whole.

In contrast with the radiused, rounded or chamfered edge or edges of the inlet 121 of the drive nozzle 120, the exit of the drive nozzle 120 provides a sharp edge at substantially 90° to the end face of the nozzle body 112 in which the drive nozzle 120 is formed. This serves to help produce a coherent jet of high-speed air exiting from the drive nozzle 120, when compressed air is provided to the drive nozzle inlet 121 and accelerated through the drive nozzle 120.

Such acceleration is provided primarily in the diverging section 124 of the nozzle 120, which provides a diameter expansion from an inner diameter di at the outlet of the inlet flow section 122 to an inner diameter do at the exit of diverging outlet flow section 124. The ratio between the inner diameter di at the outlet end of the inlet flow section 122 and the inner diameter do at the exit of the nozzle 120 will be selected in accordance with the desired characteristics of the ejector. If an ejector is designed to what is commonly referred to as "high flow", then do will be smaller relative to di, for instance $do \approx 1.3 \cdot di$. If an ejector is designed to what is commonly referred to as "high vacuum", then do will be greater relative to di, for instance $do \approx 2 \cdot di$. Thus, typical ranges between the inner diameter di at the outlet end of the inlet flow section 122 and the inner diameter do at the exit of the nozzle 120 are between 1 to 1.2 and 1 to 2.2 ($1/1.2 \leq di/do \leq 1/2.2$).

Irrespective of the presence or absence of a straight-walled section 126, and independent of the axial length chosen for the diverging outlet flow section 124, the axial length of the straight-walled inlet flow section 122 may preferably be about 5 times the inner diameter di at the outlet end of the inlet flow section 122. The axial length of the diverging outlet flow section 124, either on its own or including a straight-walled section 126 if the latter is provided, may preferably be at least twice the inner diameter do at the exit of the nozzle 120, independent of the axial length chosen for the straight-walled inlet flow section 122. Alternatively, the axial length of the straight-walled inlet flow section 122 may be about 5 times the inner diameter di at the outlet end of the inlet flow section 122, and the axial length of the diverging outlet flow section 124, including a straight-walled section 126, may be at least twice the inner diameter do at the exit of the nozzle 120.

As shown in FIGS. 1A, 2 and 3C, the drive nozzles 120 are provided in the drive nozzle array 110 so as to be aligned substantially in parallel to one another, that is with the longitudinal centre axis of each of the nozzles 120 being axially aligned in parallel with the centre axis CL of the ejector cartridge 100. Of course, the drive nozzles 120 in the drive nozzle array 110 may equally be provided with a slight divergence or convergence, in order to tailor the shape of the co-formed jet flow that is projected from the nozzle array 110 towards the inlet 131 of the second stage nozzle 132, a slight convergence being preferred over a slight divergence.

Equally, although these Figures show nozzle array 110 consisting of four drive nozzles, arranged in a two-by-two matrix, this is not any limitation on the present invention, which may include any number of drive nozzles 120, such as, specifically, two, three, four, five or six drive nozzles, arranged in a suitable grouping in the drive nozzle array 110. For example: three nozzles may be arranged at the points of a triangle; four nozzles can be arranged, as shown, at the corner of a square; five nozzles can be arranged at the corners of a pentagon, or at the corners of a square with one in the centre of the square; and six nozzles can be variously grouped, including at the corners of a hexagon.

An even larger number of drive nozzles 120 is, of course, also possible and contemplated for the drive nozzle array 110, according to purpose. It is also contemplated that the design of each drive nozzle might be varied in order to control the co-formed drive jet flow—for example, in a grouping having a centre nozzle with multiple surrounding nozzles, the centre nozzle might be configured to give a higher-speed air jet with a lower volume flow rate than each of the surrounding nozzles.

Turning to FIGS. 5A, 5B, 6, 7A to 7C and 8, there is shown a second embodiment of an ejector according to the present invention. The embodiment of FIGS. 5A, 5B, 6, 7A to 7C and 8 is also configured as an ejector cartridge 200.

The ejector 200 is similar in construction and operation to the ejector 100, and the description above of the features, components, operation and use of the ejector 100 applies equally to the ejector 200, except where further features or variations are particularly explained. Again, ejector cartridge 200 includes a first, drive stage 200A and a second stage 200B.

Figure 5A:
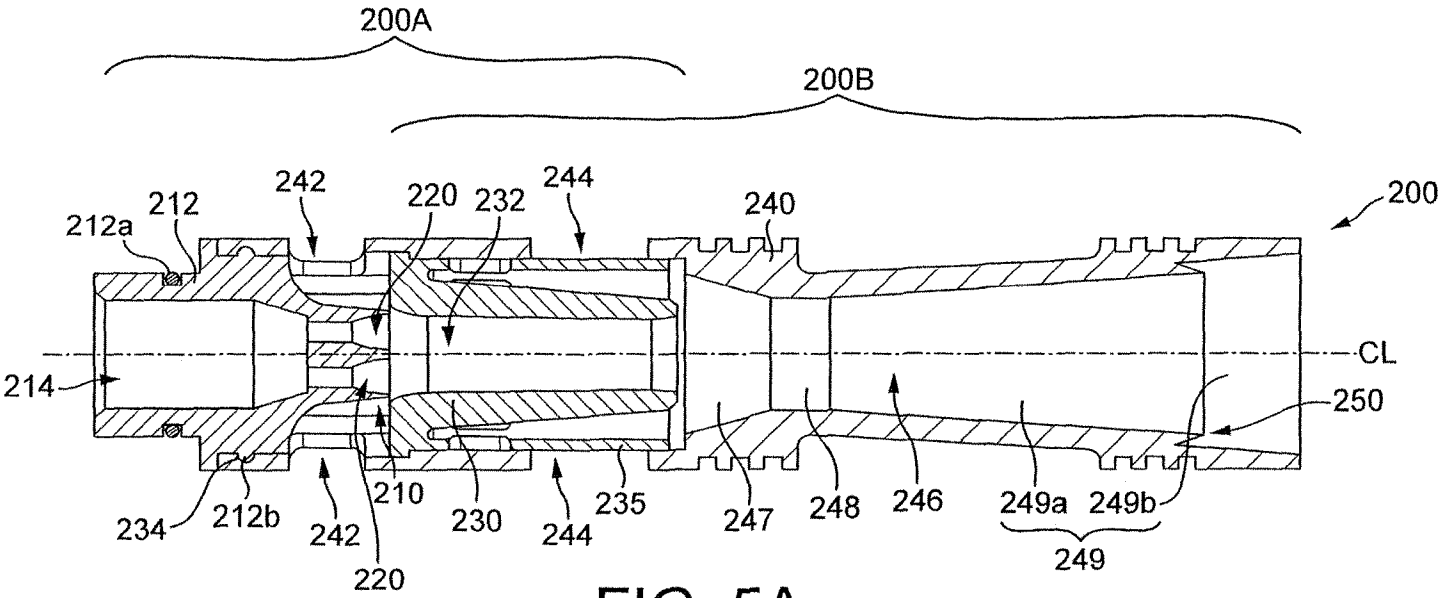
FIG. 5A shows a longitudinal, axial sectional view of a second embodiment of an ejector cartridge according to the present invention, shown along the sectional line A-A of FIG. 5B.
Figure 5B:
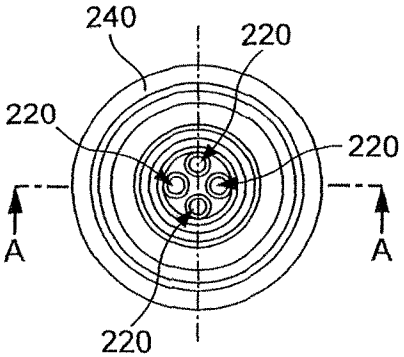
FIG. 5B shows an axial end view of the ejector cartridge of FIG. 5A seen from the exit end of the cartridge.

FIG. 5B is an axial end view, facing towards the exit end of the ejector 200, which clearly shows the outlets of the drive nozzles 220 arranged in a grouping so as to face into and along the axial passage defined by the second stage nozzle 232 and the exit nozzle 246. FIG. 5A shows the section A-A of FIG. 5B, which contains the centre axis CL, about which the ejector cartridge 200 substantially forms a body of revolution. Again, the body of the ejector cartridge 200 is substantially cylindrical, with the exception of the suction ports 242 and 244, and the diverging section of the exit nozzle.

The construction of the ejector cartridge 200 is substantially the same as that of ejector cartridge 100, with the main exception that the ejector cartridge 200 is formed to have a single housing piece 240 constituting both the drive stage 200A and the second stage 200B. The second stage nozzle is formed as a separate second stage nozzle piece 230, which is arranged to be inserted into the housing 240 from the inlet end thereof, prior to inserting the drive nozzle piece 212 also into the inlet end of the housing piece 240.

It will be apparent that the second stage nozzle body 230 is simply press-fitted into the second stage 200B part of housing 240, whereas the drive nozzle piece 212 is provided with an inter-engaging annular ridge 212*b*, configured to engage into the annular groove 234 provided as receiving structure at the inlet of the housing piece 240.

Figure 6:
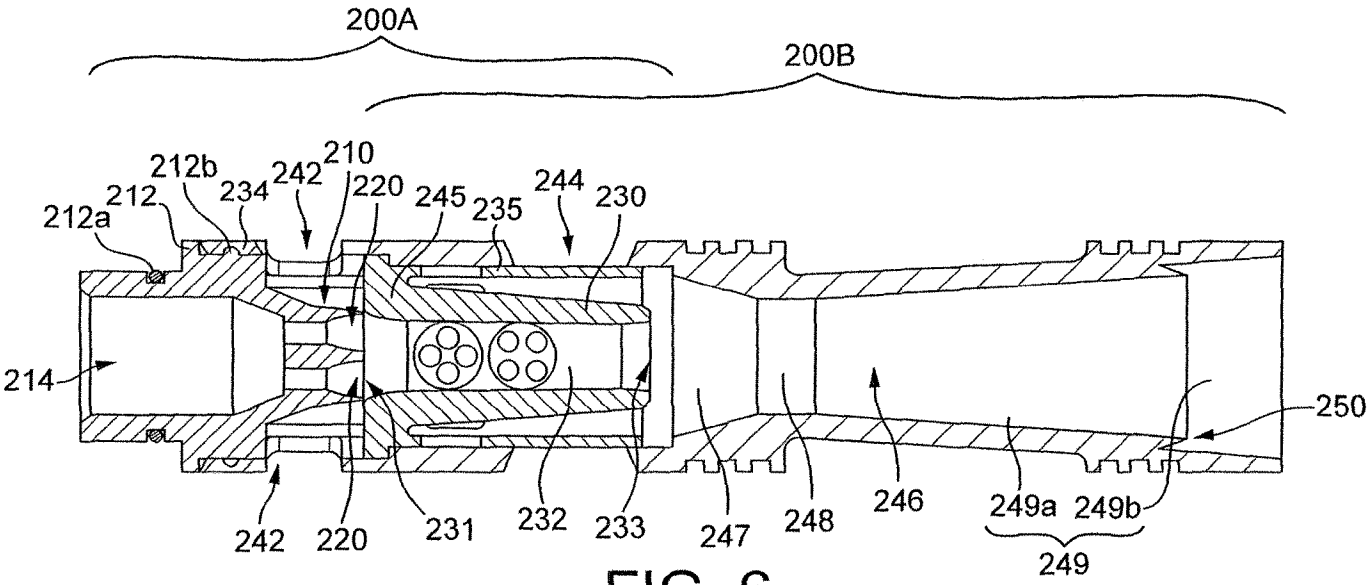
FIG. 6 again details a longitudinal, axial sectional view of the ejector cartridge of FIG. 5A, as seen in a direction perpendicular to the direction of airflow through the ejector, indicating the relationship between the grouping of the ejector array nozzles and the inner diameter of the second stage converging-diverging nozzle.
Figure 7A:
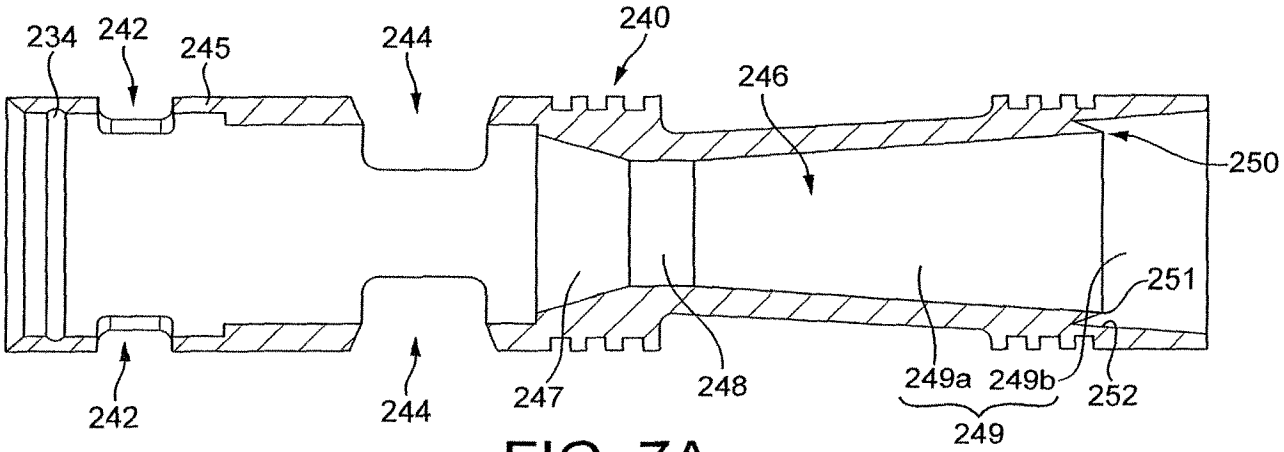
FIG. 7A shows a longitudinal, axial sectional view of the unitary ejector housing body, defining the drive stage, second stage and exit nozzle, of the ejector cartridge of FIG. 5A, as seen in a direction perpendicular to the direction of airflow through the ejector.
Figure 7B:
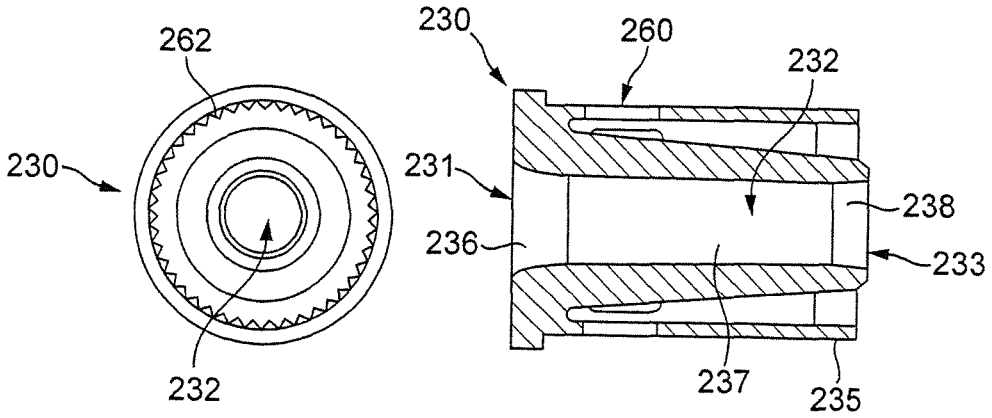
FIG. 7B shows a longitudinal, axial sectional view as seen in a direction perpendicular to the direction of airflow through it, and an axial end view from the exit end of, the second stage nozzle piece of FIG. 5A, incorporating an integral valve member therewith.
Figure 7C:
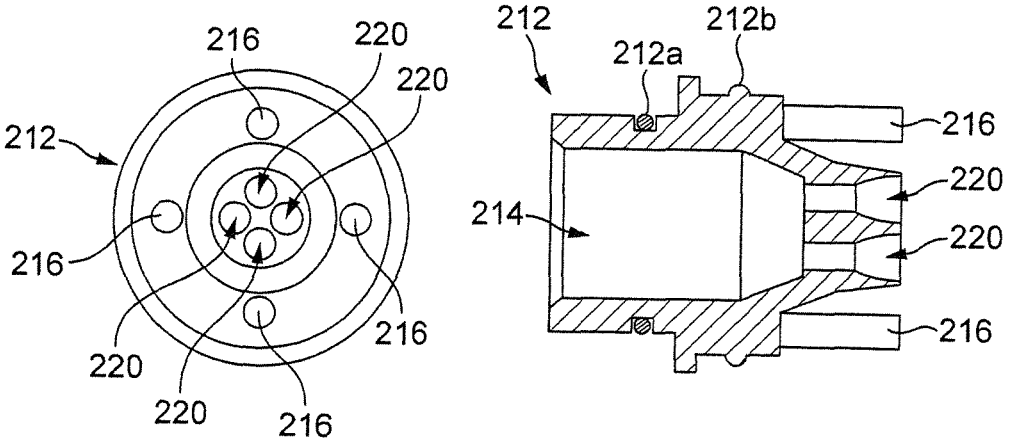
FIG. 7C shows a longitudinal, axial sectional side view as seen in a direction perpendicular to the direction of airflow through it, and axial end view from the exit end of, the drive nozzle piece of the ejector cartridge of FIG. 5A.
Figure 8:
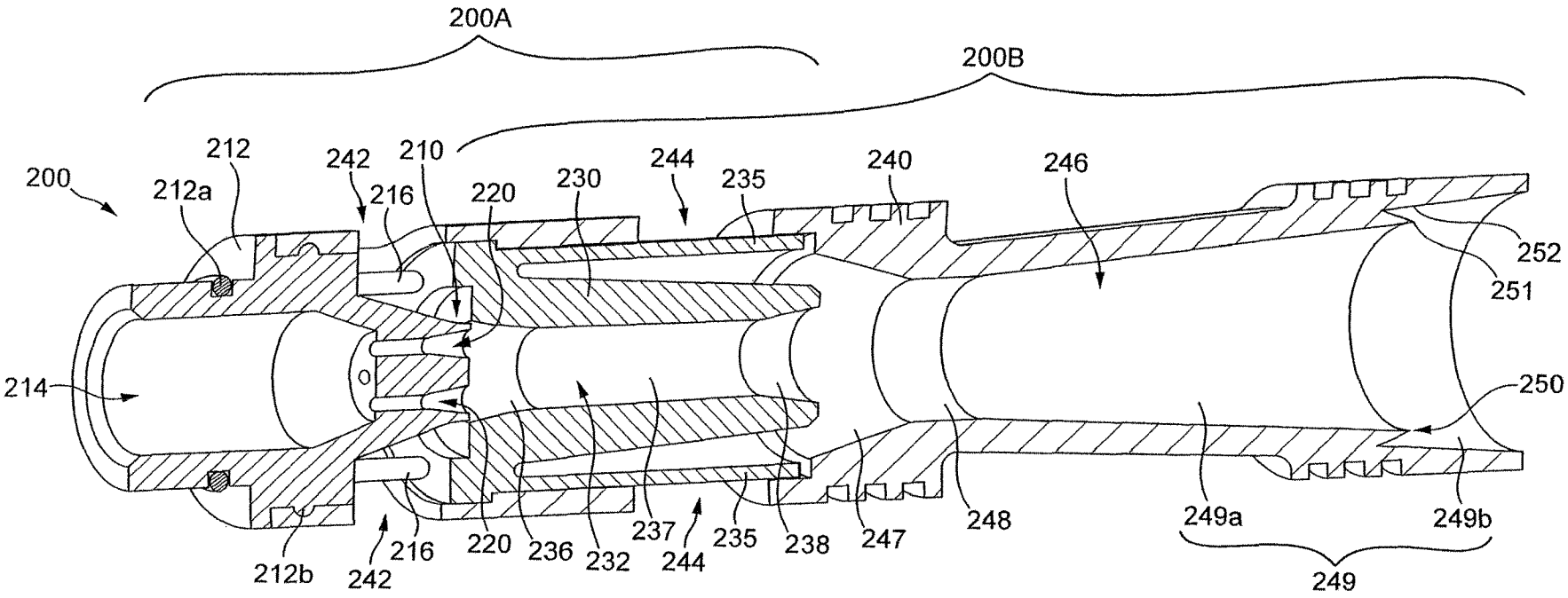
FIG. 8 shows an isometric sectional view, through a plane containing its longitudinal axis, which is parallel to the direction of airflow through it, of the ejector cartridge of FIG. 5A, detailing how the second stage nozzle piece and drive nozzle piece are mounted into the ejector housing body.

As seen more clearly in FIGS. 6 and 7C, the drive nozzle piece 212 includes rods or posts 216, which extend forwardly from a radially outer flange section of the drive nozzle piece 212, and abuttingly engage the rear side of the second stage nozzle piece 230, so as to hold it axially in place within the ejector housing 240. These posts or rods 216 function both to secure the second stage nozzle piece 230 in position within the ejector housing piece 240, and also to maintain a desired spacing between the exit of the ejector nozzles 220 of ejector nozzle array 210 and the inlet 231 to the second stage converging-diverging nozzle 232.

It will otherwise be appreciated that the ejector cartridge 200 is arranged to operate in the same manner as ejector cartridge 100, with compressed air being supplied to the inlet 214 of drive nozzle array 210 at the inlet of ejector cartridge 200, and accelerated through drive nozzles 220 of drive nozzle array 210 so as to emerge as respective drive air jets, directed together in common into the inlet 231 of the second stage nozzle 232. This array of drive air jets again entrains fluid in the surrounding volume into the drive jet flow, creating a suction which will draw surrounding fluid in through the suction ports 242 formed in the housing 240 at the first drive stage 200A. The compressed air and entrained fluid medium is then accelerated in the second stage nozzle 232 to emerge as a second stage air jet, which is directed in turn into the exit nozzle 246. Exit nozzle 246 is again defined by the housing piece 240 as a converging-diverging nozzle. As before, the high-speed air jet through the second stage 200B entrains air or other fluid medium in the volume surrounding the second stage air jet into the second stage jet flow and ejects it from the ejector 200 through the exit nozzle 246. This creates a suction force at the suction ports 244, thereby drawing in fluid medium from any surrounding volume. A valve member 235 is again provided, in order to selectively open and close the second stage suction ports 244, in dependence on the relative levels of negative pressure in the second stage 200B and the surrounding volume. In this embodiment, the valve member 235 is formed as an integral component of the second stage nozzle piece, with which it forms a unitary moulded body. The valve 235 will open when the pressure in the second stage 200B is below the pressure in the surrounding volume, and will close when the pressure in the surrounding volume falls below the pressure in the second stage 200B.

Again, as may be taken from FIG. 6, the drive nozzles 220 are arranged in a grouping which permits the air jets from all of the drive nozzles 220 to be directed together into the inlet 231 of the second stage nozzle 232. This is shown schematically in FIG. 6 by way of the drive nozzle grouping being shown as smaller circles arranged in a two-by-two matrix inside each of two adjacent larger circles which, correspond to the inner diameter of the second stage nozzle 232. The left-hand grouping in FIG. 6 corresponds to the alignment of the drive nozzles 220 as shown in FIG. 6, whereas the right-hand grouping shows how the nozzles remain within the confines of the perimeter of the second stage nozzle 232, even if the grouping is rotated through a 45° angle. In this way, it can be seen how the multiple nozzles of the drive nozzle array 210 are able to direct their respective drive jets together into the common inlet 231 of the second stage nozzle 232. As noted above, the two adjacent circles containing the drive nozzle groupings drawn in the middle channel of the second stage nozzle in FIG. 6 do not represent structural features part way along the second stage nozzle 132, but are a projection of possible drive nozzle array groupings onto the cross-section of the second stage nozzle, made for purposes of illustrating the relative alignment of these components along centre axis CL.

Referring to FIG. 7A, the housing piece 240 is shown, having an inlet end with a receiving structure 234 in the form of an annular groove for receiving the drive nozzle piece 212. First, drive stage suction ports 242 and second stage suction ports 244 are also shown, provided as openings in the otherwise substantially cylindrical body of the housing piece 240. At its distal end, the housing piece 240 defines the converging-diverging exit nozzle 246 of the ejector cartridge 200, including converging inlet section 247, straight-walled section 248 and diverging outlet section 249. As with the embodiment of FIGS. 1, 2 and 3A, the diverging portion 249 of exit nozzle 246 is provided, near the outlet end, with a stepwise expansion in diameter 250, dividing the diverging section 249 into first and second diverging sections 249*a* and 249*b*, respectively. At the stepwise expansion in diameter 250, there is formed an undercut, at which the wall of the diverging section 249, as viewed in cross-section in the direction perpendicular to the direction of air flow through the exit nozzle 246, reverses from diverging whilst extending in the axial direction towards the outlet of the ejector cartridge 200 to diverging whilst extending in the axial direction towards the inlet of the ejector cartridge 200, before reversing again to be diverging whilst extending in the axial direction towards the outlet end of the ejector cartridge 200. This reversal in the direction of the wall of the diverging section 249 creates a sharp corner 251, at the stepwise expansion 250. This stepwise expansion in diameter may have the same dimensional relationships as the stepwise expansion in diameter 150 for the outlet section 149 in the exit nozzle 146 for the ejector cartridge 100 described above.

Figure 9:
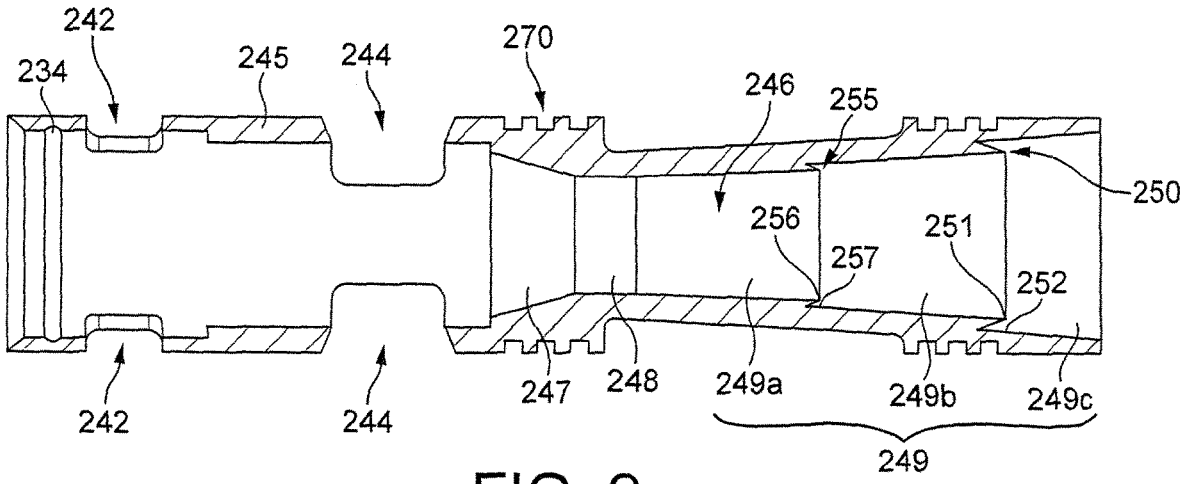
FIG. 9 shows a longitudinal, axial sectional view, as seen in a direction perpendicular to the direction of airflow through the ejector, of an alternative embodiment of a unitary ejector housing body similar to that of FIG. 5A, but having a modified diverging nozzle section, which may be used in place of the ejector housing of FIG. 5A.

It is also possible for the diverging section 249 to be provided with more than one stepwise expansion in diameter. Turning to FIG. 9, an ejector housing piece 270 is shown which represents an alternative embodiment to the ejector housing piece 240, and which may be used in place of ejector housing piece 240 in the ejector cartridge 200. As with ejector housing piece 240, ejector housing piece 270 includes receiving structure 234 at its inlet end for receiving the ejector nozzle piece 212, suction ports 242 and 244, and receiving structure 245 between the suction ports, for receiving the second stage nozzle piece 230. Again, ejector housing piece 270 defines a converging-diverging nozzle 246 at its outlet end, to provide the exit nozzle 246 for the ejector cartridge 200. This exit nozzle 246 includes a converging inlet section 247, a straight-walled middle section 248 and a diverging outlet section 249. However, in this instance, the diverging outlet section 249 is divided into first, second and third diverging sections 249*a*, 249*b* and 249*c*. Stepwise expansions in diameter 250 and 255 are provided at two positions along the length of the diverging section 249, separately the diverging section into the first, second and third diverging sections 249*a*, 249*b* and 249*c*. The stepwise expansion in diameter 250 is formed near to the outlet end of the diverging section 249, the same as in FIG. 7A. An intermediate stepwise expansion in diameter 255 is further provided, formed again by an undercut in the wall of the diverging section 249 of the outlet nozzle 246. The undercut forms a sharp corner 256 at the position of the stepwise expansion at the end of the first section 249*a*, at which point the nozzle wall, as viewed in cross-section in a direction perpendicular to the direction of air flow through the nozzle, reverses from diverging whilst extending in an axial direction towards the outlet of the nozzle to diverging whilst extending in an axial direction towards the inlet of the nozzle, before reversing again to be diverging whilst extending in the axial direction towards the outlet of the nozzle.

The angle of the diverging wall of the exit nozzle 246 in diverging section 249 is substantially the same in all three sections 249*a*, 249*b* and 249*c*, although it will be appreciated that more or less divergent angles may be used towards the exit end of the nozzle. Again, the purpose of the stepwise expansions in diameter 250, 255 in the diverging section 249 of exit nozzle 246 is to trip the air flow into a turbulent air flow, so as to reduce the friction at the nozzle wall that is experienced by the air passing through the exit nozzle 246, and so influence resistance to air flow through the ejector cartridge 200 as a whole.

As seen in FIG. 9, the intermediate stepwise expansion 255 does not provide for as large an increase in diameter as the stepwise expansion 250 provided near to the outlet end of the nozzle 246. Thus, the increase in diameter between the sharp corner 256 and the point 257 on the inner wall of the nozzle 246 radially in line with the sharp corner 256, but in the second divergent section 249*b*, is smaller than the step in diameter between the sharp corner 251 at the second stepwise expansion in diameter 250, to the point 252 which is radially in line with the sharp corner 251 on the wall of the third diverging nozzle section 249*c*.

Returning to FIG. 7A, it will be seen that the ejector housing piece 240 also includes a receiving structure 245, in the form of a shoulder, for receiving the second stage nozzle piece 230. Second stage nozzle piece 245, as shown in FIG. 7B, is provided with a radially outer flange at its inlet end to abut with the corresponding shoulder formed in the receiving structure 245 of nozzle piece 240.

The second stage nozzle piece 230 shown in FIG. 7B furthermore defines the converging-diverging second stage nozzle 232, including converging inlet section 236, straight-walled middle section 237 and diverging outlet section 238, extending between the inlet 231 and outlet 233 of the second stage nozzle 232. In the second stage nozzle piece 230 of FIG. 7B, the valve member 235 is integrally formed with the nozzle piece 230, so as to provide for the selective opening and closing of the second stage suction ports 244 in the ejector housing piece 240 or 270 of the ejector cartridge 200. To facilitate flexibility in the valve member 235, openings 260 may be provided near to the base of the valve member 235, so as to allow the valve member 235 to open and close more easily with respect to the suction ports 244.

FIG. 7B shows, in one view, a cross-sectional view of the nozzle piece 230 in a direction perpendicular to the direction of air flow through the nozzle piece 230, and also shows the nozzle piece 230 in an axial end view, as seen from the outlet end 233 of the nozzle 232. In this latter view, a plurality of teeth 262 can also be seen, which are formed near to the base of the valve member 235, on the outside of the second stage nozzle body 230. Teeth 262 are arranged to engage with corresponding teeth which may be provided in the engaging structure 245 of the ejector housing piece 240 or 270. These teeth are provided to facilitate rotational alignment of the second stage nozzle body 230 with the ejector housing piece 240 or 270 of the ejector cartridge 200. Such alignment will often not be necessitated, in particular given the rotationally-symmetric form of the ejector cartridge 200. However, in certain embodiments, the ejector housing piece 240 or 270 may be provided with second stage suction ports 244 which are not evenly distributed around the circumference of the ejector housing, or the second stage nozzle piece 230 may be provided with separate valve members 235 corresponding to each of the suction ports 244, necessitating alignment between the valve members 235 and the respective suction ports 244 which they are to selectively open and close.

It will be appreciated that no sealing member is provided in order to prevent air leaking around the second stage nozzle piece 230 between the first, drive stage 200A and the second stage 200B. This is in view of the fact that the second stage nozzle piece 230 is intended to be made from a relatively soft and conforming rubber or plastic, which will conform to the inner dimension of the ejector housing piece 240 or 270 to form an airtight seal therewith. In cooperation with the posts or rods 216 provided on the drive nozzle piece 212, which hold the second stage nozzle piece 230 axially in position, this will provide a secure seal around the inlet end of the second stage nozzle piece 230.

Turning to FIG. 7C, the drive nozzle piece 212 is shown, again in a cross-sectional view seen in a direction perpendicular to the direction of airflow through the drive nozzle piece 212, and viewed in the axial direction looking from the outlet end of the drive nozzles 220. Drive nozzle piece 212 has an inlet 214 for receiving compressed air from a compressed air supply, and for providing the compressed air to the plurality of drive nozzles 220 in the drive nozzle array 210. Drive nozzles 220 of the drive nozzle array 210 may be formed in the same way as drive nozzle 120 shown in FIG. 4.

The drive nozzle piece 212 is formed with an annular ridge 212*b* (or a series of projections arranged in a ring around the circumference of the drive nozzle piece 230) which is sized to engage with an annular groove 234 of the receiving structure at the inlet end of ejector housing piece 240 or 270, so as to secure the drive nozzle piece 212 into the housing piece 240 of the ejector cartridge 200. It will be appreciated that, in place of the annular ridge 212*b*, the drive nozzle piece 212 could be provided with an annular groove, and an elastomeric O-ring could be provided in the groove of the drive nozzle piece to engage with the groove 234 of the ejector housing piece 240 or 270, when the drive nozzle piece 212 is fitted therein, so as to secure the two pieces together. It will also be appreciated that there is no need to provide an airtight seal at the receiving structure 234, since the necessary sealing between the ejector cartridge 200 and the outside volume to be evacuated is obtained through the use of elastomeric seal 212*a* (as may be understood with reference to FIG. 12, to be discussed further below). Equally, the ridge 212*b* could be formed as a groove, and a ridge provided in place of the groove of the receiving structure 234 of the ejector housing piece 240 or 270, to be received in the groove of the drive nozzle piece 212.

The secure snap-fitting of the drive nozzle piece 212 into the inlet end of the ejector housing piece 240 or 270 further secures the second stage nozzle piece 230 in place, as the rods or posts 216, which extend from the drive nozzle piece 212 in a forward axial direction, are arranged to press against the back surface of the second stage nozzle piece 230 to secure it against the shoulder provided in the receiving structure 245 of the ejector housing piece 240 or 270. The second stage nozzle piece 230 is thus axially secured in place, and is also spaced the desired axial distance from drive nozzle array 210. It will readily be appreciated that the use of rods or posts 216, in addition to providing the necessary structural stability, also provides for the unobstructed flow of air or other fluid medium surrounding the ejector cartridge 200 into the drive stage 200A through the suction ports 242.

Turning to FIG. 9, there is shown a cross-sectional perspective view of the ejector cartridge 200, which details how the second stage nozzle piece 230 and drive nozzle piece 212 are mounted into the ejector housing 240 and arranged to provide for an axial flow of high speed air generated by the drive nozzles 220 and directed successively through the second stage nozzle 232 and the exit nozzle 246. FIG. 9 also illustrates how air flow through the suction ports 242 and 244 can be entrained into the jet flow created by the air jets produced by the drive nozzles 220 and the second stage nozzle 232 in the respective first, drive stage 200A and second stage 200B.

Figure 10:
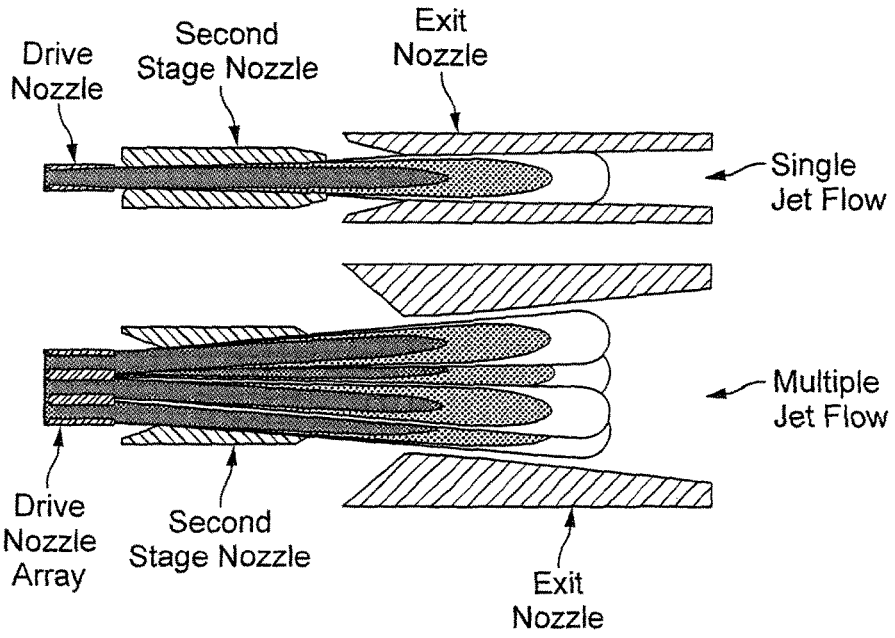
FIG. 10 shows a schematic comparison between the flow development through a multi-stage series of nozzles having a single drive nozzle and a multi-stage series of nozzles having a drive nozzle array including four drive nozzles.

Turning to FIG. 10, this figure shows a comparison between a single drive jet flow generated by a single drive nozzle and allowed to expand in an axial sequential flow through a second stage nozzle and an exit nozzle in side-by-side relation to a multiple drive jet flow as may be generated by the ejector cartridges 100 and 200, which have four drive nozzles 120, 220 in the respective drive nozzle arrays 110, 210. As can be appreciated from this representative illustration, the development of the fluid flow through the second stage nozzle and exit nozzle for the multiple drive jet flow example is substantially the same as for the single drive jet flow example of the conventional ejectors.

Even so, it has been found that the multiple drive nozzle arrangement allows an ejector cartridge to produce a superior performance in terms of the negative pressure which is generated and the volume flow rate through the ejector cartridge than for a single drive nozzle multi-stage ejector of the construction shown in FIGS. 14 and 15 of the present application. Put another way, in order to obtain the same performance as a multi-stage ejector of the design of FIGS. 14 and 15, a multi-stage ejector according to the present invention, having multiple drive nozzles, is able to generate the same performance using a smaller quantity of compressed air, thereby providing a greater level of efficiency. Additionally, for ejectors of equivalent performance, the ejectors of the present invention, having multiple drive nozzles in the drive nozzle array, are shorter and have a smaller footprint than ejectors of the design shown in FIGS. 14 and 15. In particular, both designs of ejector may have a substantially equivalent diameter for the same level of performance, but the ejector cartridge of FIGS. 14 and 15 require a three-stage arrangement in order to obtain the same levels of performance which the ejector cartridges of the present invention, as exemplified by the embodiments 100 and 200 described above, are able to achieve with only a two-stage arrangement. Accordingly, for equivalent performance, the ejector cartridges according to the present invention can be made smaller in size and of reduced footprint as compared with the ejector cartridges of the prior art.

With reference to the above embodiments of the ejector cartridges 100 and 200, it will be appreciated that the second stage nozzle piece 130, 230 and the drive nozzle piece 112, 212 may be received within the corresponding receiving structures into which they are fitted not only via the press-fit or snap-fit arrangements as illustrated in the accompanying drawings, but equally by any alternative form of mating or threaded engagement, or furthermore by being glued, welded or otherwise fixed into place.

As regards the manufacturing of the components of the ejector cartridges 100 and 200, it is preferred that the ejector cartridge housing pieces 130, 140, 240 or 270, and the drive nozzle pieces 112, 212 be formed by a one-shot moulding process using a suitable plastics material, as will be known to the skilled person.

In the case of the unitary, integrally moulded second stage nozzle piece 230, the material has to provide the necessary flexibility to allow the valve member 235 to open and close the suction ports 244, whilst at the same time being structurally rigid enough so that the desired flow development will occur through the converging-diverging nozzle 232. As such, the second stage nozzle piece 230 is preferably formed from a relatively compliant material, being either a plastic or rubber, and preferably being made from a suitable thermoplastic elastomer formulation, such as the thermoplastic polyurethane elastomer (TPE(U)) available from BASF under the trade designation Elastollan®, S-series, from a soft thermoplastic vulcanizate (TPV) such as Santoprene™ TPV 8281-65MED as available from ExxonMobil Chemical Europe, from NBR or other suitable materials. Common fluor rubber or FPM rubber would be another suitable material.

The specific material to be used for moulding the second stage ejector piece 230 will, in practice, be determined by the intended use for the ejector cartridge 200. Specifically, it is envisaged to use TPE(U) for most applications, but to use standard type Viton® A, B or F as available from E. I. du Pont de Nemours and Company where chemical resistance is important.

It is envisaged that the drive nozzles 120 and 220 may be formed in the drive nozzle pieces 112, 212 during the moulding process by which the nozzle pieces 112, 212 are formed. Equally, the drive nozzles 120 and 220 may be formed in an already-moulded nozzle piece 112, 212, such as by boring, where sufficient dimensional accuracy is not possible at the time of moulding of the drive nozzle piece 112, 212. As for the second stage nozzle 132, 232 and the exit nozzle 146, 246, it is envisaged that these will be formed as part of the moulding process by which the respective components 130, 230, 140, 240 are formed, without need of subsequent manufacturing steps.

Figure 11A:
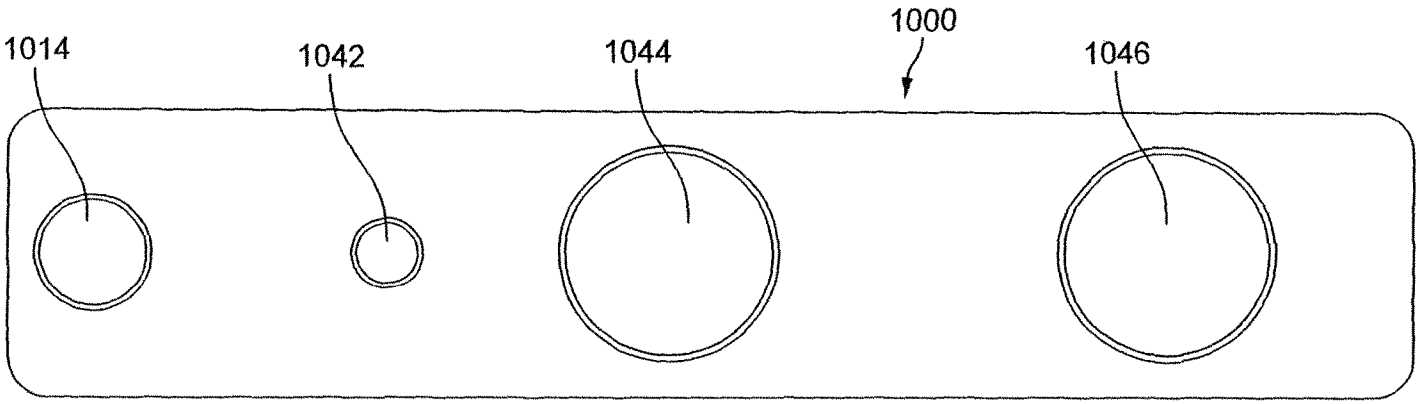
FIGS. 11A to 11C illustrate an embodiment of an ejector, having the ejector cartridge of FIG. 1A mounted in an ejector housing module and connected to a mounting plate, with FIG. 11A showing an underside view of the ejector housing module detailing the inlet, outlet and suction ports.
Figure 11B:
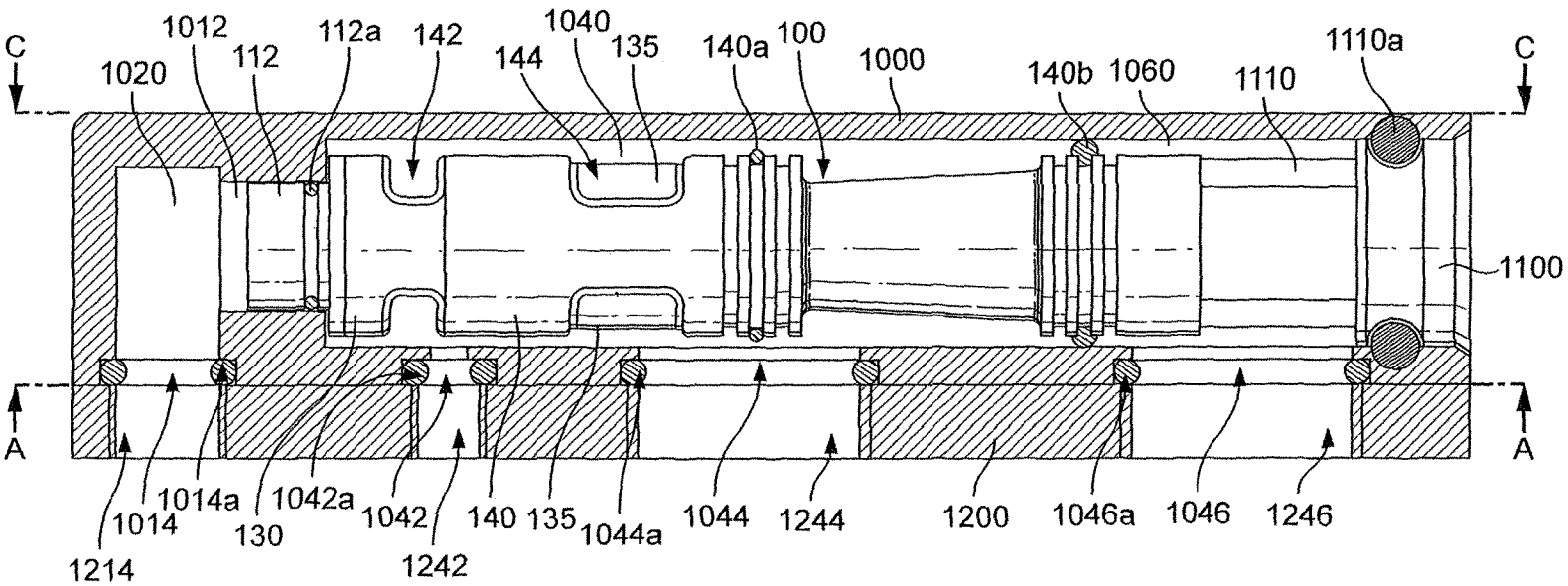
Figure 11C:
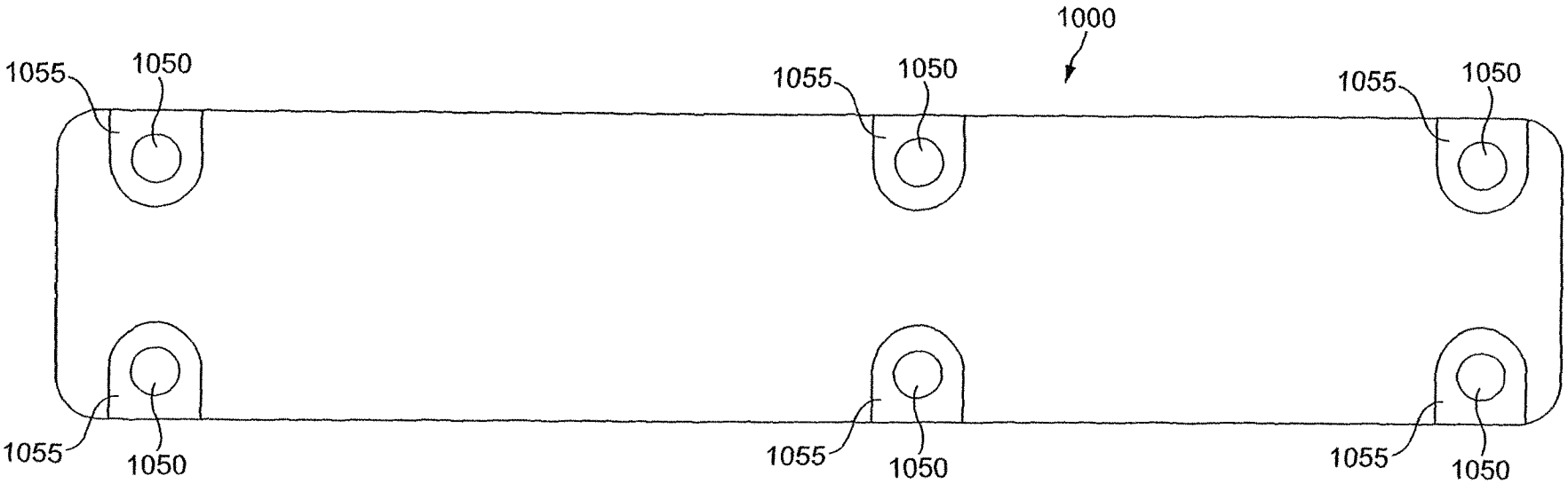

With reference now to FIGS. 11A to 11C, there is shown an example of how an ejector cartridge 100 (equivalently, the ejector cartridge 200) may be mounted into a housing module 1000, for use in a vacuum pump or similar.

FIG. 11B shows the ejector 100 mounted into an internal bore 1012, 1040, 1060 formed in housing module 1000. O-ring seals 112*a* and 140*b* provide a seal, respectively, between the drive nozzle piece 112 and an inlet bore 1012 of the housing module 1000, and between an outside of the second stage ejector housing piece 140 and the inside of the bore defined in the housing module, so as to separate the bore into an intermediate vacuum chamber 1040 and an exit chamber 1060. The housing module 1000 is provided with an inlet chamber 1020, to which a compressed air source is to be connected in order to provide the ejector cartridge 100 with a supply of compressed air. Inlet bore 1012 is connected into the inlet chamber 1020, so that the compressed air is supplied to the inlet 114 of the drive nozzle piece 112. In operation, the compressed air forms a stream of high speed jet flow through the ejector 100, which creates a suction force at the suction ports 142 and 144, at the drive stage and second stage, respectively, of the ejector 100, before the compressed air and any entrained fluid from the surrounding volume is ejected through the exit nozzle 146 into exit chamber 1060. A muffler or alternative stop member 1100 is provided in the opening of the housing module bore, so as to close off the exit chamber 1060 to contain the fluid ejected from the ejector 100 and to suppress noise caused by this high speed jet flow of air exiting from the exit nozzle 146 of the ejector 100. Stop member 1100 is provided with arms or rods 1110 arranged to secure the ejector cartridge 100 axially in place in the bore of housing module 1000. The stop member 1100 may be secured in place using a suitable sealing member such as elastomeric O-ring 1100*a*, or may be otherwise threaded, secured, welded or glued in place in a sealing fashion in order to close off the bore of the housing module 1000.

The air ejected from ejector 100 is, instead of being expelled to atmosphere on exit from the ejector 100, conveyed away from the housing module 1000 through exit port 1046, formed in the base of the housing module 1000. In this way, compressed air is supplied into the housing module through the inlet port 1014, and the compressed air and any entrained fluid evacuated from the surrounding volume is expelled from the housing module 1000 through the exit port 1046. Housing module 1000 is furthermore provided with suction ports 1042 and 1044, which are arranged to connect the volume in the vacuum chamber 1040 which surrounds the first and second stage suction ports 142 and 144 of the ejector 100 with a volume to be evacuated. The volume to be evacuated may comprise, for example, one or more suction cups or other suction devices, or any other vacuum-operated machinery.

In the example shown in FIG. 11B, the housing module 1000 is connected along its base surface to a connection plate 1200 of a vacuum-operated device, the connection plate 1200 being provided with ports 1214, 1242, 1244 and 1246 which correspond to the ports 1014, 1042, 1044 and 1046 formed in the base of the housing module 1000. Elastomeric seals, such as O-rings 1014*a*, 1042*a*, 1044*a* and 1046*a* are provided between the corresponding ports of the housing module 1000 and the ports 1214, 1242, 1244 and 1246 of the connector plate 1200. Port 1214 of the connector plate 1200 is connected to a compressed air supply, for supplying compressed air through the inlet port 1014 into the inlet chamber 1020 of the housing module 1000. Likewise, air expelled through the outlet 1046 of the housing module 1000 is carried away through the outlet passage 1246 in connector plate 1200. Similarly, ports 1242 and 1244 in connector plate 1200 connect the vacuum generated by the ejector 100 to the volume to be evacuated, with air or other fluid medium in the volume to be evacuated being drawn through the ports 1242, 1244 in connector plate 1200, through the suction inlets 1042 and 1044 in the housing module 1000 and into the vacuum chamber 1040 formed in the bore surrounding the first and second stages 100A, 100B of the ejector cartridge 100.

In the early stages of vacuum generation, a large differential pressure will exist across the second stage 100B of the ejector cartridge 100 and the valve member or members 135 will open so that fluid medium will be entrained through the suction inlet 144 and into the second stage jet flow, as well as simultaneously being entrained into the drive section 100A through the suction ports 142. However, as the vacuum in the volume to be evacuated increases, so that a higher negative pressure (i.e., a lower absolute pressure) is generated, the pressure differential across the valve members 135 will reduce, until these valve members close, at which point only the drive stage 100A will provide suction to the chamber 1040 through the suction port 142, which in turn provides suction through the suction ports 1042 and 1044 of the housing module to the ports 1242, 1244 of the connecting plate 1200.

By mounting the ejector cartridge in a housing module in this way, the vacuum generated by the ejector cartridge 100 can be selectively applied, via the connecting plate 1200, to associated connected vacuum-operated equipment, as desired.

FIG. 11A shows the disposition of the inlet port 1014, suction ports 1042, 1044 and outlet port 1046 of the housing module 1000. It will be appreciated that the position of the inlet port, outlet port and suction ports in the housing module 1000 does not necessarily correspond to the location of the inlet 114, suction ports 142, 144, and ejector exit nozzle 146 of the ejector cartridge 100, but instead necessarily corresponds to the position of the inlet port 1214, suction ports 1242, 1244 and outlet port 1246 of the connector plate 1200 to which the housing module 1000 is to be attached. However, since the suction ports 142, 144 are arranged to evacuate the entire vacuum chamber 1040 which surrounds the first and second stages 100A and 100B of the ejector cartridge 100, it is not necessary to provide alignment between the suction ports 142, 144 of the ejector cartridge 100 and the suction ports 1042, 1044 of the housing module 1000, provided that there is a suitable location within the bore of the housing module 100 where the elastomeric O-ring 140*b* is able to seal off the bore of the housing module to form the vacuum chamber 1040 and exit chamber 1060.

Turning to FIG. 11C, there is illustrated an arrangement of connectors for interconnecting one or more modular housing units together, using bores, such as threaded bores 1050 provided in the housing module 1000, each threaded bore 1050 being provided with a recessed area 1055 surrounding the bore opening at its upper end, to permit a connecting member, such as a screw or bolt, to be recessed relative to the upper surface of the housing module 1000. Such connector holes may also be used to attach the housing module 1000 to the connector plate 1200, as appropriate.

Figure 12:
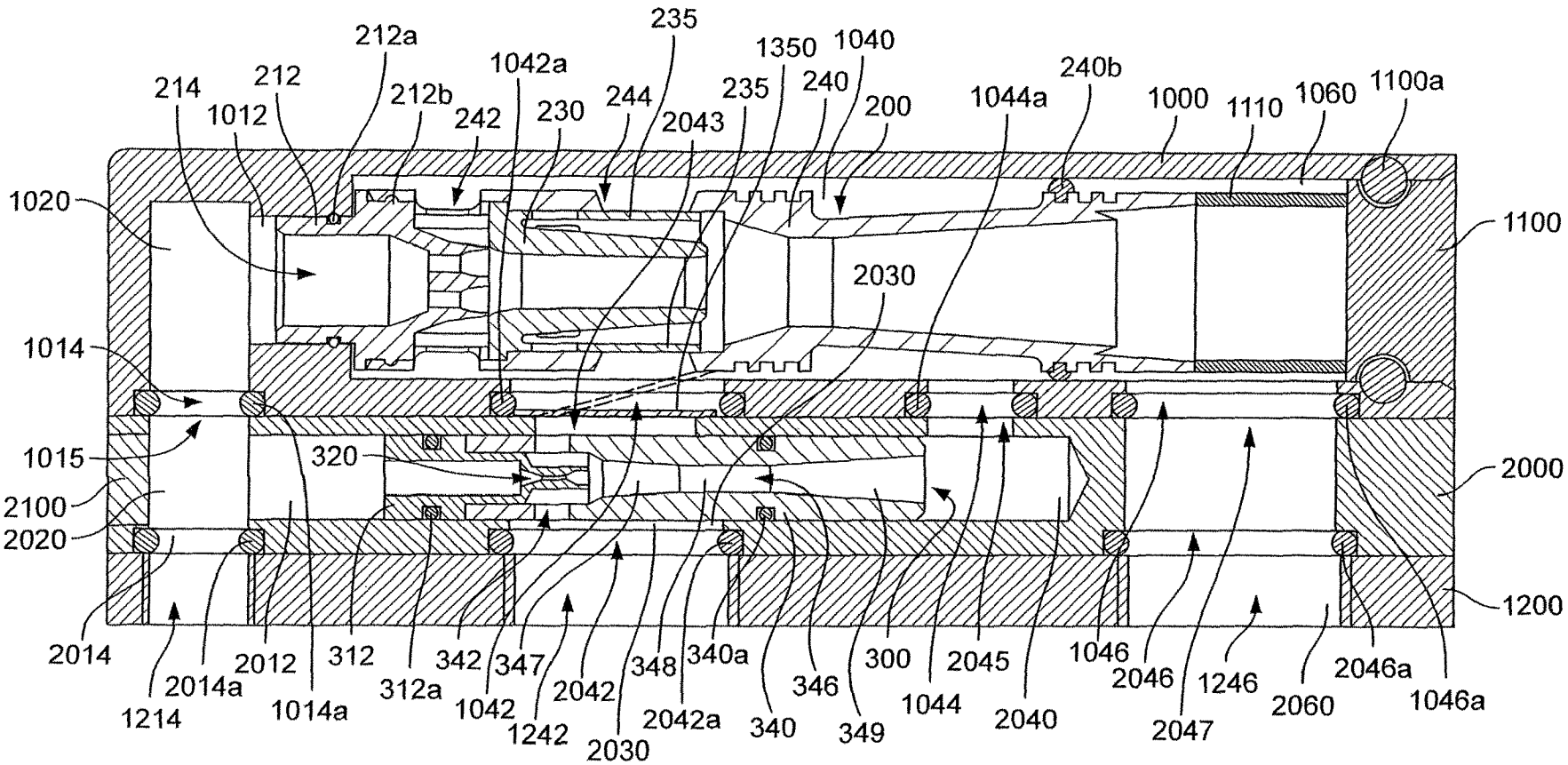
FIG. 12 shows a longitudinal, axial sectional view, as seen in a direction perpendicular to the direction of airflow through the ejector cartridge, of an ejector with a similar ejector housing module to that of FIGS. 11A to 11C, but in which the ejector cartridge of FIG. 5A is mounted in place of the ejector cartridge of FIG. 1A, and further having a booster ejector module mounted between the mounting plate and the ejector housing module.
Figure 13:
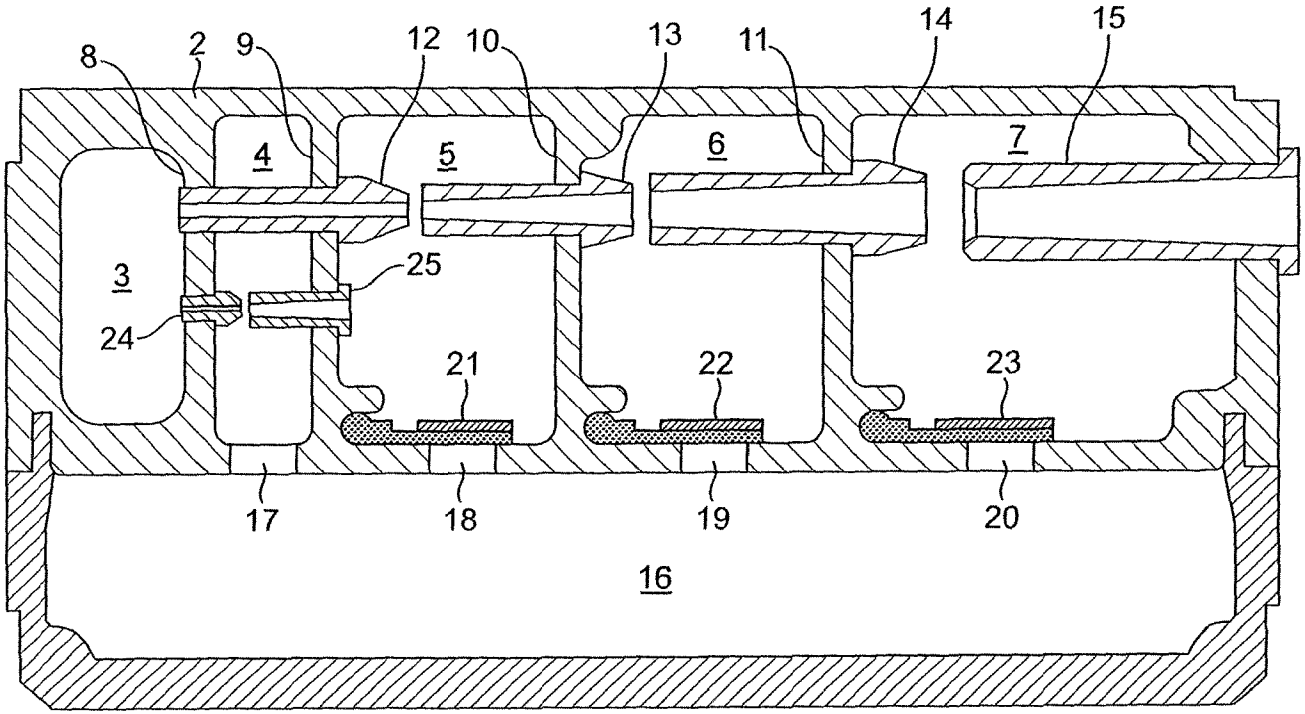
FIG. 13 shows a prior art ejector unit including a booster stage incorporated into a common housing in parallel with the in-line series of multi-stage ejector nozzles.

One use for such a modular housing arrangement is shown in FIG. 12, in which the ejector 100 has been replaced, merely by way of example, by ejector cartridge 200 in the housing module 1000. However, in this example, the housing module 1000 is not connected directly to the connector plate 1200, but is instead connected onto a booster module 2000, which houses a booster ejector 300, the booster module 2000 being in turn connected to a connector plate 1200. In this example, the connector plate 1200 includes an inlet port 1214, a single suction port 1242, and an outlet port 1246.

The housing module 1000 is otherwise as described in respect of FIG. 11, with the exception that the suction port 1042 is provided with a valve member 1350, which permits selective opening and closing of the suction port 1042 between the vacuum chamber 1040 of housing module 1000 and the booster stage of booster ejector 300.

Booster module 2000 includes an inlet chamber 2020 for receiving compressed air from the inlet port 1214 of the connector plate 1200 through a corresponding inlet port 2014. The inlet chamber 2020 of the booster module 2000 is connected to an inlet bore 2012 of the booster module 2000, in which the booster ejector 300 is mounted, in order to supply compressed air to the inlet of the booster ejector 300. This bore in which the booster ejector 300 is mounted may, for example, be formed by drilling into the booster module 2000 from the side adjacent to the inlet chamber 2020, and so a stop member 2100 is provided in order to seal off the borehole opening. The inlet chamber 2020 also provides an outlet port 2015, which connects inlet chamber 2020 to the inlet port 1014 of the housing module 1000 in order to simultaneously supply compressed air to the inlet of the ejector cartridge 200.

The booster module 2000 includes a suction port 2042 for applying suction to the suction port 1242 of the connector plate 1200 from a vacuum chamber 2030. Vacuum chamber 2030 is likewise connected to the vacuum chamber 1040 of the housing module via a port 2033 in the booster module 2000 and the suction port 1042 in the housing module 1000. In this way, the vacuum generated by the ejector cartridge 200 can be applied to the volume to be evacuated by drawing the air or other fluid medium to be evacuated through the suction port 1242 of the connection plate 1200, through the suction port 2042, through the vacuum chamber 2030, through the ports 2030 and 1042, through the vacuum chamber 1040 and into the suction ports 242 and 244 of the ejector cartridge 200. In practice, this will happen during the early stages of supplying compressed air to the ejector arrangement shown in FIG. 12, as the ejector cartridge 200 is able to entrain a substantially larger volume of air into the drive stage 200A and second stage 200B than is the booster cartridge 300. However, once the vacuum produced in the volume to be evacuated drops below the highest negative pressure value (i.e., the lowest absolute pressure) which the ejector 200 can generate, the valve 1350 will close, to prevent a backflow of air from the evacuation chamber 1040 surrounding the ejector 200 into the chamber 2030 which surrounds the booster ejector 300.

Booster ejector 300 comprises a pair of nozzles, being a drive nozzle 320 and an exit nozzle 346, which together form a booster stage, across which a high vacuum (low absolute pressure) is obtained. Specifically, drive nozzle 320 directs a high speed air jet into the inlet of the converging-diverging nozzle 346, thereby entraining air or other fluid medium in the volume surrounding the air jet into the booster jet flow and so creating a vacuum at the suction port 342 which is connected to the chamber 2030 to be evacuated and which is in turn connected to the suction port 2042 of the booster module which is sealed to the suction port 1242 of the connector plate 1200, so as to evacuate a connected volume to be evacuated.

The booster drive nozzle 320 may have a similar configuration to the drive nozzles 120 and 220 as described above, but is specifically designed to achieve a high vacuum level (low absolute pressure), in combination with the converging-diverging nozzle 346 which is formed of a converging section 347, straight-walled middle section 348 and diverging exit section 349. The fluid expelled by nozzle 346 from the outlet of the booster ejector 300 is discharged into a chamber 2040 in the booster module 2000, which is in turn connected, via an outlet port 2045, to the suction port 2044 of the housing module 1000. In this way, the air which is ejected through the booster ejector 300 is subsequently entrained into the jet flow of the ejector cartridge 200 via the suction ports 242 and/or 244, and then ejected out of the ejector cartridge 200 into the ejection chamber 1060, through the outlet port 1046 and an associated port 2047 of the booster module, through an outlet passage 2060 of the booster module 2000, through an outlet port 2046 of the booster module and out through the outlet port 2046 of the connector plate 1200.

As will be appreciated, the booster drive nozzle 320 is formed as part of a nozzle body 312, which is press fitted or otherwise secured in the bore 2012 provided in the booster module 2000. The booster exit nozzle 346 is likewise formed as part of a booster outlet nozzle piece 340, which is also press fitted or otherwise secured in the bore formed in the booster module 2000 which defines the exit chamber 2040. Respective elastomeric seals, such as O-rings 340*a* and 312*a*, seal off each end of the booster ejector 300, so as to define the evacuation chamber 2030 to be evacuated by the booster ejector 300. As shown in FIG. 12, elastomeric seals, such as O-rings 1014*a*, 1042*a*, 1044*a*, 1046*a*, 2014*a*, 2042*a* and 2046*a* are provided at the respective inlet and outlet ports of the housing module 1000 and the booster module 2000, to provide airtight seals between the adjacent ports and connected chambers.

With the arrangement shown in FIG. 12, the ejector cartridge 200 can provide a high level of vacuum within a short space of time, and this is supplemented by the booster cartridge 300 so as to further increase the negative pressure (i.e., further reduce the absolute pressure) which is applied to the volume to be evacuated, to which the housing module 1000 and booster module 2000 are connected via port 1242 of the connector plate 1200.

It is also to be noted that the suction provided by the ejector cartridge 200 to the suction port 1044 reduces the pressure in the exit chamber 2040 at the outlet of the booster ejector 300, such that the pressure differential across the booster ejector 300, between the inlet chamber 2020 and the outlet chamber 2040, is increased. This, in turn, can be used to obtain a further increase in the vacuum level (i.e., a further reduction in the absolute pressure) which the booster ejector 300 is able to achieve.

The invention claimed is:

1. A multi-stage ejector for generating a vacuum from a source of pressurized fluid by passing said pressurized fluid through a series of nozzles, accelerating said pressurized fluid, and entraining air or other medium so as to form a jet flow in one or more stages and generate the vacuum to evacuate a sealed volume, the multi-stage ejector comprising:

a primary ejector, comprising:

a first drive stage configured for generating a first vacuum having a first pressure;

a second stage; and a converging-diverging nozzle provided in said series of nozzles between said first drive stage and said second stage for receiving said jet flow from said first drive stage and accelerating said jet flow to form a second stage fluid jet and directing said second stage fluid jet into an inlet of an outlet nozzle of the second stage, wherein:

said primary ejector is an ejector cartridge comprising a housing defining said first drive stage and said second stage and having a molded single material nozzle piece mounted therein;

said housing further defines one or more openings for communicating said first drive stage and said second stage with the sealed volume;

said converging-diverging nozzle is formed in the molded single material nozzle piece mounted in said primary ejector, and said nozzle piece further includes one or more valve elements integrally molded with said nozzle piece to form a single unitary piece, the valve elements designed to move from an open position to a closed position and arranged to open and close the one or more openings communicating with said second stage to control a direction of flow of the air or other medium and the fluid between the second stage and the sealed volume to be evacuated; and a booster ejector connected in parallel with the primary ejector for simultaneously generating a vacuum across a booster stage, the booster ejector configured to generate a second vacuum having a second pressure lower than the first pressure, when both the booster ejector and the primary ejector are in operation, wherein the booster ejector and said primary ejector are connected to the sealed volume to be evacuated and a valve configured to close a connection between the primary ejector and the sealed volume to be evacuated when a pressure in the sealed volume to be evacuated falls below the first pressure.

2. The multi-stage ejector of claim 1, wherein said one or more valve elements are formed as one or more flap valves.

3. The multi-stage ejector of claim 2, wherein said nozzle piece includes holes or detents provided at a base of the one or more flap valves to increase flexibility at a hinge portion of the one or more flap valves.

4. The multi-stage ejector of claim 1, wherein said nozzle piece is molded either from plastic or rubber.

5. The multi-stage ejector of claim 4, wherein the plastic or rubber is selected from the group consisting of a thermoplastic polyurethane elastomer, a soft thermoplastic vulcanizate (TPV), fluor rubber, and FPM rubber.

6. The multi-stage ejector of claim 1, wherein said nozzle piece includes a rotationally symmetric mounting structure by which it is mounted into the multi-stage ejector, the nozzle piece further comprising one or more locating elements which fix a rotational orientation of said nozzle piece about an axis of rotational symmetry of the mounting structure with respect to the multi-stage ejector.

7. The multi-stage ejector of claim 6, wherein said one or more locating elements includes one or more teeth disposed around said mounting structure to permit the rotational orientation of the nozzle piece to be adjusted and to be fixed at different orientations.

8. The multi-stage ejector of claim 1, wherein said series of nozzles includes a drive nozzle array comprising two or more nozzles arranged to generate respective fluid jets and to feed said fluid jets together in common into the converging-diverging nozzle as said jet flow from said first drive stage.

9. The multi-stage ejector of claim 1, wherein said ejector cartridge is suitable to be mounted into the sealed volume for evacuating said sealed volume and a connected volume to be evacuated.

10. The multi-stage ejector of claim 1, wherein said ejector cartridge housing is rotationally symmetric around an axis parallel to the direction of fluid flow through the ejector cartridge, said series of nozzles being arranged along said axis of rotational symmetry of the ejector cartridge housing.

11. The multi-stage ejector of claim 1, wherein said ejector cartridge housing further defines the outlet nozzle as a final nozzle in said series of nozzles at an exit end of the ejector cartridge.

12. The multi-stage ejector of claim 1, wherein the second stage is configured for generating a third vacuum having a third pressure.

13. A method of making a multi-stage ejector for generating a vacuum from a source of pressurized fluid by passing said pressurized fluid through a series of nozzles, accelerating said pressurized fluid, and entraining air or other medium so as to form a jet flow in at least a first drive stage and a second stage and generate a first vacuum across one of the first drive stage or the second stage, the method comprising:

mounting a molded nozzle piece including a converging-diverging nozzle between the first drive stage and the second stage of a primary ejector, wherein:

said multi-stage ejector includes an ejector cartridge comprising a housing defining said first drive stage and said second stage and having said molded nozzle piece mounted therein;

said housing further defines one or more openings for communicating one of said first drive stage or said second stage with a surrounding sealed volume;

said molded nozzle piece is formed of a single material and includes one or more valve elements integrally molded therewith to form a single unitary piece, the one or more valve elements designed to move from an open position to a closed position, mounting the molded nozzle piece includes aligning the one or more valve elements with corresponding one or more openings of the housing, of the second stage, through which the vacuum generated in the second stage is communicated with the surrounding sealed volume to be evacuated, the aligned one or more valve elements are disposed to open and close said one or more openings to control a direction of flow of the air or other medium and the fluid between the second stage and the surrounding sealed volume to be evacuated; and mounting a booster ejector in parallel with the primary ejector to simultaneously generate a second vacuum having a second pressure lower than a first pressure of the first vacuum, wherein the booster ejector and the primary ejector are connected to the sealed volume to be evacuated and a valve configured to close a connection between the primary ejector and the sealed volume to be evacuated when a pressure in the sealed volume to be evacuated falls below the first pressure.

* * * * *